US011027811B2

(12) United States Patent
Saito

(10) Patent No.: US 11,027,811 B2
(45) Date of Patent: Jun. 8, 2021

(54) OUTBOARD MOTOR LIFTING DEVICE

(71) Applicant: Showa Corporation, Gyoda (JP)

(72) Inventor: Takahiko Saito, Fukuroi (JP)

(73) Assignee: Showa Corporation, Gyoda (JP)

( * ) Notice: Subject to any disclaimer, the term of this patent is extended or adjusted under 35 U.S.C. 154(b) by 33 days.

(21) Appl. No.: 16/675,811

(22) Filed: Nov. 6, 2019

(65) Prior Publication Data

US 2020/0307752 A1 Oct. 1, 2020

(30) Foreign Application Priority Data

Mar. 25, 2019 (JP) ..... JP2019-057060

(51) Int. Cl.
*B63H 20/10* (2006.01)
*B63H 20/08* (2006.01)
*B63H 20/12* (2006.01)

(52) U.S. Cl.
CPC ..... *B63H 20/10* (2013.01); *B63H 20/08* (2013.01); *B63H 20/12* (2013.01)

(58) Field of Classification Search
CPC ..... B63H 20/00; B63H 20/02; B63H 20/06; B63H 20/08; B63H 20/10; B63H 20/12; B63H 20/14; B63H 21/21; B63H 21/22; B63H 21/26
USPC ..... 440/53, 61 R, 61 T
See application file for complete search history.

(56) References Cited

U.S. PATENT DOCUMENTS 3,722,455 A 3/1973 Carpenter
5,032,094 A 7/1991 Katogi
5,215,484 A * 6/1993 Saito ..... B63H 21/265 440/61 R

FOREIGN PATENT DOCUMENTS

JP 58-028159 B2 6/1983
JP 02-099494 A 4/1990

* cited by examiner

*Primary Examiner* — Lars A Olson
(74) *Attorney, Agent, or Firm* — Leason Ellis LLP

(57) ABSTRACT

An outboard motor lifting device includes a hydraulic source, a first oil channel connecting the hydraulic source with a second chamber of a tilt cylinder, a second oil channel connecting the first oil channel with a second chamber of a trim cylinder, a third oil channel connecting the hydraulic source with a first chamber of the tilt cylinder, a check valve provided between the second chamber of the tilt cylinder and a connection position between the first and second oil channels, a fourth oil channel connected to the third oil channel, and a switch valve provided on the second oil channel and connected with the fourth oil channel. The switch valve has a connection state where communication between the first oil channel and the second chamber of the trim cylinder is closed, and communication between the fourth oil channel and the second chamber of the trim cylinder is open.

12 Claims, 16 Drawing Sheets

OUTBOARD MOTOR LIFTING DEVICE

CROSS-REFERENCE TO RELATED APPLICATIONS

This application is based upon and claims the benefit of priority to Japanese patent application No. 2019-057060, filed on Mar. 25, 2019, the entire contents of which are incorporated herein by reference.

TECHNICAL FIELD

The present invention relates to an outboard motor lifting device.

BACKGROUND ART

In a full field, there has been known an outboard motor lifting device including a tilt cylinder mainly serving for lifting an outboard motor up above water or lifting the outboard motor down below the water, and a trim cylinder mainly serving for changing an angle of the outboard motor below the water (for example, JP-T-S58-028159 and JP-A-H2-99494).

The outboard motor lifting device is preferable to suitably retain and lift up and down the outboard motor.

An object of the present invention is to provide an outboard motor lifting device which can retain and lift up and down an outboard motor suitably.

According to an aspect of the present invention, there is provided an outboard motor lifting device configured to lift up and down an outboard motor. The outboard motor lifting device includes: one or more tilt cylinders, each including a piston that partitions the tilt cylinder into a first chamber and a second chamber, and a rod that is connected to the piston and penetrates the first chamber of the tilt cylinder; one or more trim cylinders, each including a piston that partitions the trim cylinder into a first chamber and a second chamber, and a rod that is connected to the piston and penetrates the first chamber of the trim cylinder; a hydraulic power source; a first oil channel that connects the hydraulic power source with the second chamber of the one or more tilt cylinders; a second oil channel that connects the first oil channel with the second chamber of the one or more trim cylinders; a third oil channel that connects the hydraulic power source with the first chamber of the one or more tilt cylinders; a check valve that is provided on the first oil channel between the second chamber of the one or more tilt cylinders and a connection position between the first oil channel and the second oil channel, and that is configured to prohibit hydraulic oil from flowing out of the second chamber of the one or more tilt cylinders; a fourth oil channel that is connected to the third oil channel; and a switch valve that is provided on the second oil channel and to which the fourth oil channel is connected. A connection state of the switch valve includes: a first connection state in which communication between the first oil channel and the second chamber of the one or more trim cylinders is in a closed state, and communication between the fourth oil channel and the second chamber of the one or more trim cylinders is in an open state.

According to another aspect of the present invention, there is provided an outboard motor lifting device configured to lift up and down an outboard motor. The outboard motor lifting device includes: one or more tilt cylinders, each including a piston that partitions the tilt cylinder into a first chamber and a second chamber, and a rod that is connected to the piston and penetrates the first chamber of the tilt cylinder; one or more trim cylinders, each including a piston that partitions the trim cylinder into a first chamber and a second chamber, and a rod that is connected to the piston and penetrates the first chamber of the trim cylinder; a hydraulic power source; a first oil channel that connects the hydraulic power source with the first chamber of the one or more tilt cylinders; a second oil channel that connects the hydraulic power source with the second chamber of the one or more tilt cylinders; a first pump port that includes a first shuttle chamber connected to the first oil channel, and a second shuttle chamber connected to the second oil channel; a second pump port that includes a third shuttle chamber connected to the first shuttle chamber, and a fourth shuttle chamber connected to the second shuttle chamber; a third oil channel that connects the first oil channel with the second chamber of the one or more trim cylinders; a fourth oil channel that connects the fourth shuttle chamber with the second chamber of the one or more trim cylinders; a first switch valve that is provided on the third oil channel; and a second switch valve that is provided on the fourth oil channel.

According to the above configuration, an outboard motor lifting device can be provided which can retain and lift up and down an outboard motor suitably.

DESCRIPTION OF EMBODIMENTS

Embodiment 1

An outboard motor lifting device 1 according to Embodiment 1 of the present invention will be described below with reference to FIGS. 1 to 10.

Figure 1:
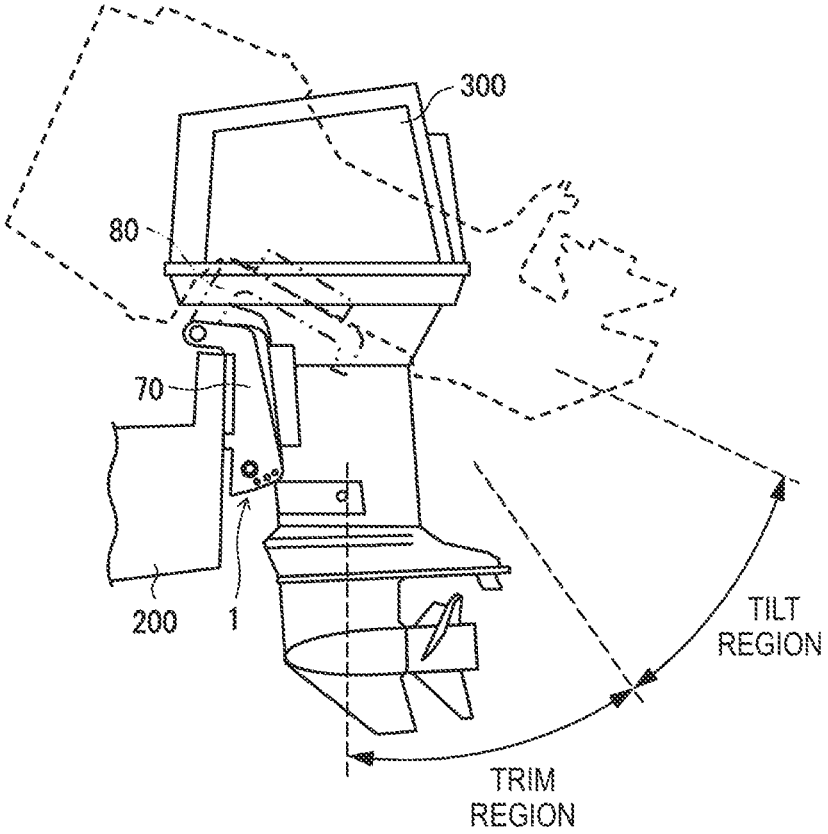
FIG. 1 is a view showing a usage example of an outboard motor lifting device according to Embodiment 1.
Figure 2:
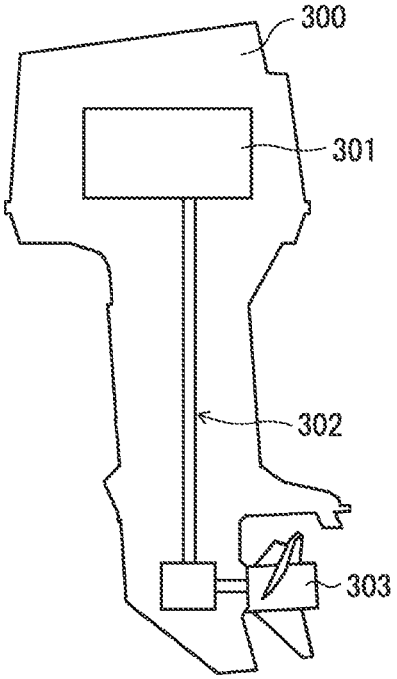
FIG. 2 is a view showing a schematic internal configuration of an outboard motor according to Embodiment 1.

The outboard motor lifting device 1 is configured to lift up and down an outboard motor 300. FIG. 1 is a view showing a usage example of the outboard motor lifting device 1. The outboard motor lifting device 1 shown in FIG. 1 is attached to a rear portion of a hull (body) 200 and the outboard motor 300. A solid line in FIG. 1 illustrates a state in which the outboard motor 300 is lifted down. A broken line in FIG. 1 illustrates a state in which the outboard motor 300 is lifted up. FIG. 2 is an outline view schematically showing an internal configuration of the outboard motor 300. As shown in FIG. 2, the outboard motor 300 includes an engine 301, a propeller 303, and a power transmission mechanism 302 which transmits motive power from the engine 301 to the propeller 303. Here, the power transmission mechanism includes, for example, a shaft and a gear.

Figure 3:
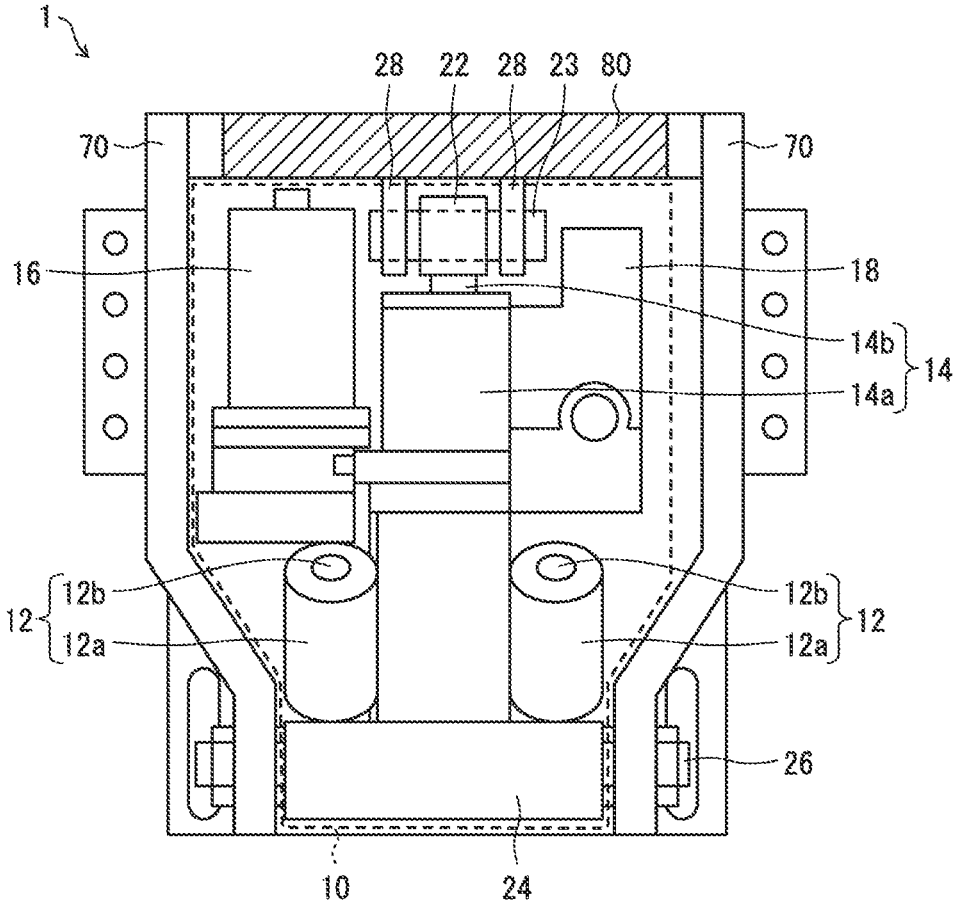
FIG. 3 is a front view showing an example of the configuration of the outboard motor lifting device according to Embodiment 1.
Figure 4:
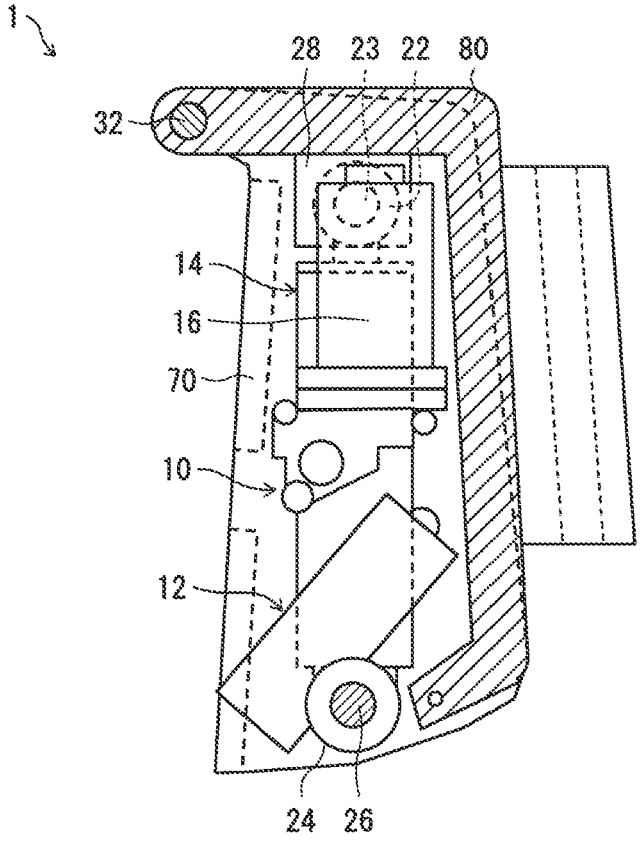
FIG. 4 is a sectional side view of the outboard motor lifting device according to Embodiment 1.

FIG. 3 is a front view showing an example of the configuration of the outboard motor lifting device 1. FIG. 4 is a sectional side view of the outboard motor lifting device 1. As shown in FIG. 3, the outboard motor lifting device 1 includes a cylinder unit 10, a pair of stern brackets 70, and a swivel bracket 80. The pair of stern brackets 70 are attached to the rear portion of the hull 200. The swivel bracket 80 is attached to the outboard motor 300.

As shown in FIG. 3, the cylinder unit 10 includes, for example, two trim cylinders 12, one tilt cylinder 14, a motor 16, a tank 18, an upper portion joint 22, and a base portion 24. The trim cylinders 12 and the tilt cylinder 14 are provided relatively immovably to the base portion 24.

Incidentally, the number of trim cylinders 12 and the number of tilt cylinders 14 provided to the cylinder unit 10 are not limited to those of the present embodiment. A cylinder unit 10 including one or more trim cylinders 12 and one or more tilt cylinders 14 may be also within the present embodiment. Moreover, the following description can be also applied to such a cylinder unit 10 having any number of trim cylinders 12 and any number of tilt cylinders 14.

Each of the trim cylinders 12 includes a cylinder 12*a*, a piston 12*c* (see FIG. 5), and a piston rod 12*b*. The piston 12*c* is provided slidably inside the cylinder 12*a*. The piston rod 12*b* is fixed to the piston 12*c*. The tilt cylinder 14 includes a cylinder 14*a*, a piston 14*c* (see FIG. 5) and a piston rod 14*b*. The piston 14*c* is provided slidably inside the cylinder 14*a*. The piston rod 14*b* is fixed to the piston 14*c*.

As shown in FIG. 3, through holes are respectively formed in the base portion 24 and the stern brackets 70, and the base portion 24 and the stern brackets 70 are connected to each other relatively rotatably through an undershaft 26 penetrating the through holes.

As shown in FIG. 3, the upper portion joint 22 is provided in a front end of the piston rod 14*b*, and support members 28 are fixed to the swivel bracket 80. Through holes are respectively formed in the upper portion joint 22 and the support members 28, and the upper portion joint 22 and the swivel bracket 80 are connected to each other relatively rotatably through an upper shaft 23 penetrating the through holes.

Through holes are respectively formed in one ends of upper portions of the stern brackets 70 and the swivel bracket 80. As shown in FIG. 4, the stern brackets 70 and the swivel bracket 80 are connected to each other relatively rotatably through a support shaft 32 penetrating the through holes.

(Trim Region and Tilt Region)

As the piston rod 14*b* of the tilt cylinder 14 goes up and down, the swivel bracket 80 goes up and down. Accordingly, the outboard motor 300 is lifted up and down.

An angle region of the outboard motor 300 adjusted by up and down of the piston rod 14*b* of the tilt cylinder 14 includes a trim region and a tilt region shown in FIG. 1. The tilt region is an angle region where distal ends of the piston rods 12*b* of the trim cylinders 12 cannot abut against the swivel bracket 80. An angle of the outboard motor 300 in the tilt region is adjusted by the piston rod 14*b* of the tilt cylinder 14.

On the other hand, the trim region is an angle region where the distal ends of the piston rods 12*b* of the trim cylinders 12 can abut against the swivel bracket 80. An angle of the outboard motor 300 in the trim region can be adjusted by both the piston rods 12*b* of the trim cylinders 12 and the piston rod 14*b* of the tilt cylinder 14. However, as will be described later, the angle of the outboard motor 300 may be adjusted by only the piston rod 14*b* of the tilt cylinder 14 also in the trim region in the present embodiment.

(Oil-Hydraulic Circuit)

Next, an oil-hydraulic circuit of the outboard motor lifting device 1 will be described with reference to FIG. 5. In the following description, members similar to or the same as the above-described members will be referred to by the same signs correspondingly and respectively while description about the members will be omitted.

Figure 5:
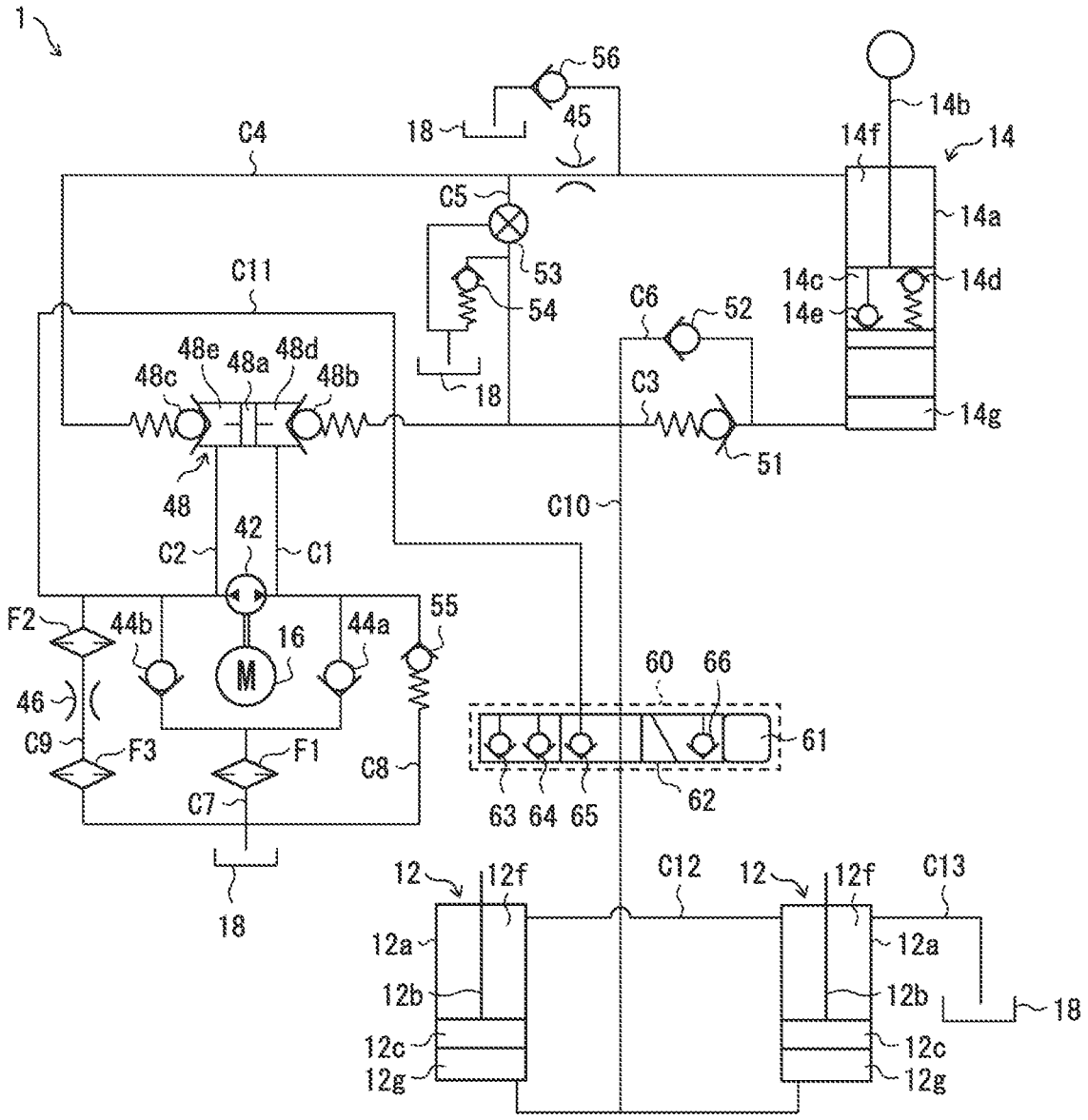
FIG. 5 is a diagram showing the configuration of an oil-hydraulic circuit of the outboard motor lifting device according to Embodiment 1.

As shown in FIG. 5, the outboard motor lifting device 1 include the motor 16, a pump 42 (which will be also referred to as hydraulic power source), the tilt cylinder 14, the trim cylinders 12, a switch valve 60, a first check valve 44*a*, a second check valve 44*b*, a main valve 48 (which will be also referred to as pump port), a third check valve 51, a fourth check valve 52, a manual valve 53, a thermal valve 54, an upblow valve 55, an upper chamber oil supply valve 56, a first orifice 45, a second orifice 46, the tank 18, filters F1 to F3, and a first flow channel C1 to a thirteenth flow channel C13.

The pump 42 serving as a hydraulic power source driven by the motor 16 is a normal/reverse rotation type hydraulic power source including a first discharge port and a second discharge port. The pump 42 performs one of a "normal rotation", a "reverse rotation" and a "stop" in accordance with control performed by a user. Hydraulic oil is stored in the tank 18.

As shown in FIG. 5, the main valve 48 includes a spool 48*a*, a first check valve 48*b*, and a second check valve 48*c*. The main valve 48 is partitioned by the spool 48*a* into a first shuttle chamber 48*d* on the first check valve 48*b* side and a second shuttle chamber 48*e* on the second check valve 48*c* side.

The first flow channel C1 connects the first discharge port of the pump 42 with the first shuttle chamber 48*d*, and connects the first discharge port of the pump 42 with the first check valve 44*a*. The second flow channel C2 connects the second discharge port of the pump 42 with the second shuttle chamber 48*e*, and connects the second discharge port of the pump 42 with the second check valve 44*b*.

The tilt cylinder 14 is partitioned by the piston 14*c* into an upper chamber 14*f* and a lower chamber 14*g*. As shown in FIG. 5, the piston 14*c* of the tilt cylinder 14 includes a shock blow valve 14*d* and a return valve 14*e*.

Incidentally, in the description of the present invention, the terms "upper" and "lower" in the "upper chamber" and the "lower chamber" are terms merely used for distinguishing those from each other. It does not have to always mean that the upper chamber is positioned on a vertically upper side than the lower chamber. Therefore, the "upper chamber" may be expressed as, among a first chamber and a second chamber into which the cylinder is partitioned by the piston, the first chamber which is penetrated by the rod connected to the piston, and the "lower chamber" may be expressed as, among the first chamber and the second chamber into which the cylinder is partitioned by the piston, the second chamber which is not penetrated by the rod connected to the piston.

Each of the trim cylinders 12 is partitioned by the piston 12*c* into an upper chamber 12*f* and a lower chamber 12*g*.

The first check valve 48*b* is connected with the lower chamber 14*g* of the tilt cylinder 14 through the third flow channel C3. The second check valve 48*c* is connected with the upper chamber 14*f* of the tilt cylinder 14 through the fourth flow channel C4. As shown in FIG. 5, the upper chamber oil supply valve 56 is connected to the fourth flow channel C4.

The manual valve 53 and the thermal valve 54 are connected to the fifth flow channel C5 connecting the third flow channel C3 with the fourth flow channel C4. As shown in FIG. 5, the first office 45 is disposed on the fourth flow channel C4 between a connection position with the upper chamber oil supply valve 56 and a connection position with the fifth flow channel C5.

Incidentally, the first flow channel C1 and the third flow channel C3 which connect the first discharge port of the pump 42 with the lower chamber 14*g* of the tilt cylinder 14 through the main valve 48 will be also collectively referred to as first oil channel. The second flow channel C2 and the fourth flow channel C4 which connect the second discharge port of the pump 42 with the upper chamber 14*f* of the tilt cylinder 14 through the main valve 48 will be also collectively referred to as third oil channel.

The tenth flow channel C10 (which will be also referred to as second oil channel) connects the third flow channel C3 with the lower chambers 12*g* of the trim cylinders 12. The switch valve 60 is disposed on the tenth flow channel C10.

The eleventh flow channel C11 (which will be also referred to as fourth flow channel) connects the second flow channel C2 with the tenth flow channel C10 through the switch valve 60. Incidentally, the eleventh flow channel C11 may connect the fourth flow channel C4 between the second shuttle chamber 48*e* and a connection position with the fifth flow channel C5, with the tenth flow channel C10 through the switch valve 60.

The third check valve 51 is disposed on the third flow channel C3 between the lower chamber 14*g* of the tilt cylinder 14 and a connection position with the tenth flow channel C10. When hydraulic oil is pumped from the second discharge port of the pump 42, the third check valve 51 opens the third flow channel C3. Otherwise, the third check valve 51 closes the third flow channel C3. Specifically, the third check valve 51 closes the third flow channel C3 when hydraulic oil is pumped from the first discharge port of the pump 42 or when pumping of hydraulic oil from the pump 42 is stopped.

The sixth flow channel C6 connects the third flow channel C3 between the lower chamber 14*g* of the tilt cylinder 14 and the third check valve 51, with the third flow channel C3 between the third check valve 51 and the first shuttle chamber 48*d*. The fourth check valve 52 is disposed on the sixth flow channel C6. When hydraulic oil is pumped from the first discharge port of the pump 42, the fourth check valve 52 opens the sixth flow channel C6. When hydraulic oil is pumped from the second discharge port of the pump 42, the fourth check valve 52 closes the sixth flow channel C6.

Incidentally, the third check valve 51 and the fourth check valve 52 will be also collectively referred to as a check valve. The oil-hydraulic circuit according to the present embodiment uses the check valve to prohibit hydraulic oil from flowing out of the lower chamber 14*g* of the tilt cylinder 14.

The seventh flow channel C7 connects the first check valve 44*a* and the second check valve 44*b* with the tank 18 through the filter F1.

The eighth flow channel C8 connects the first flow channel C1 with the tank 18 through the upblow valve 55.

The ninth flow channel C9 connects the second flow channel C2 with the tank 18 through the filter F2 and the filter F3. As shown in FIG. 5, the second orifice 46 is disposed on the ninth flow channel C9 between the filter F2 and the filter F3.

The twelfth flow channel C12 connects the upper flow channels 12*f* of the trim cylinders 12 to each other. Due to the presence of the twelfth flow channel C12, pressures in the upper chambers 12*f* of the trim cylinders 12 are equalized to each other.

The thirteenth flow channel C13 connects one of the upper chambers 12*f* of the trim cylinders 12 with the tank 18.

The first check valve 44*a* supplies hydraulic oil from the tank 18 to the pump 42 when the pump 42 still recovers hydraulic oil even in a state in which the trim cylinders 12 and the tilt cylinder 14 have retracted completely.

When the tilt cylinder 14 extends, the second check valve 44*b* supplies hydraulic oil corresponding to a leave volume of the piston rod 14*b*, from the tank 18 to the pump 42. When the trim cylinders 12 extend, the second check valve 44*b* supplies hydraulic oil corresponding to leave volumes of the piston rods 12, from the tank 18 to the pump 42.

The manual valve 53 can be opened and closed manually. As the manual valve 53 is changed to an open state during maintenance or the like of the outboard motor lifting device 1, hydraulic oil can be returned from the lower chamber 14*g* of the tilt cylinder 14 to the tank 18. Thus, the tilt cylinder 14 can be retracted manually.

When the volume of the hydraulic oil increases due to an increase of temperature, the thermal valve 54 returns excess hydraulic oil to the tank 18.

When the pump 42 still pumps hydraulic oil even in a state in which the trim cylinders 12 and the tilt cylinder 14 have extended completely, the upblow valve 55 returns excess hydraulic oil to the tank 18.

(Switch Valve 60)

As shown in FIG. 5, the switch valve 60 provided on the tenth flow channel C10 includes a solenoid 61, and a plunger 62 which is driven by the solenoid 61 to switch a connection state of the switch valve 60. The solenoid 61 switches the connection state of the switch valve 60 in accordance with control performed by a user.

The connection state of the switch valve 60 includes a first connection state, a second connection state and a third connection state. In the first connection state, the switch valve 60 closes communication between the third flow channel C3 and the lower chambers 12*g* of the trim cylinders 12, but opens communication between the eleventh flow channel C11 and the lower chambers 12*g* of the trim cylinders 12. In the second connection state, the switch valve 60 closes communication between the third flow channel C3 and the lower chambers 12*g* of the trim cylinders 12, and closes communication between the eleventh flow channel C11 and the lower chambers 12*g* of the trim cylinders 12. In the third connection state, the switch valve 60 opens communication between the third flow channel C3 and the lower chambers 12*g* of the trim cylinders 12, but closes communication between the eleventh flow channel C11 and the lower chambers 12*g* of the trim cylinders 12.

Incidentally, in the present embodiment, the plunger 62 includes a first protective valve 66 for preventing an excessive increase of oil pressure in each of the lower chambers 12*g* of the trim cylinders 12 in the first connection state. Further, the plunger 62 includes a second protective valve 65 for preventing an excessive increase of oil pressure in each of the lower chambers 12*g* of the trim cylinders 12 in the second connection state. Still further, the plunger 62 includes a third protective valve 64 and a fourth protective valve 63 for preventing an excessive increase of oil pressure in each of the lower chambers 12*g* of the trim cylinders 12 in the third connection state.

(Operation Example of Outboard Motor Lifting Device 1)

Next, an operation example of the outboard motor lifting device 1 will be described with reference to FIGS. 5 to 10.

(First Lifting Up Operation)

A flow of hydraulic oil of the oil-hydraulic circuit for performing a lifting up operation of the outboard motor 300 by means of only the tilt cylinder 14 (which will be referred to as first lifting up operation) will be described below with reference to FIG. 6.

Figure 6:
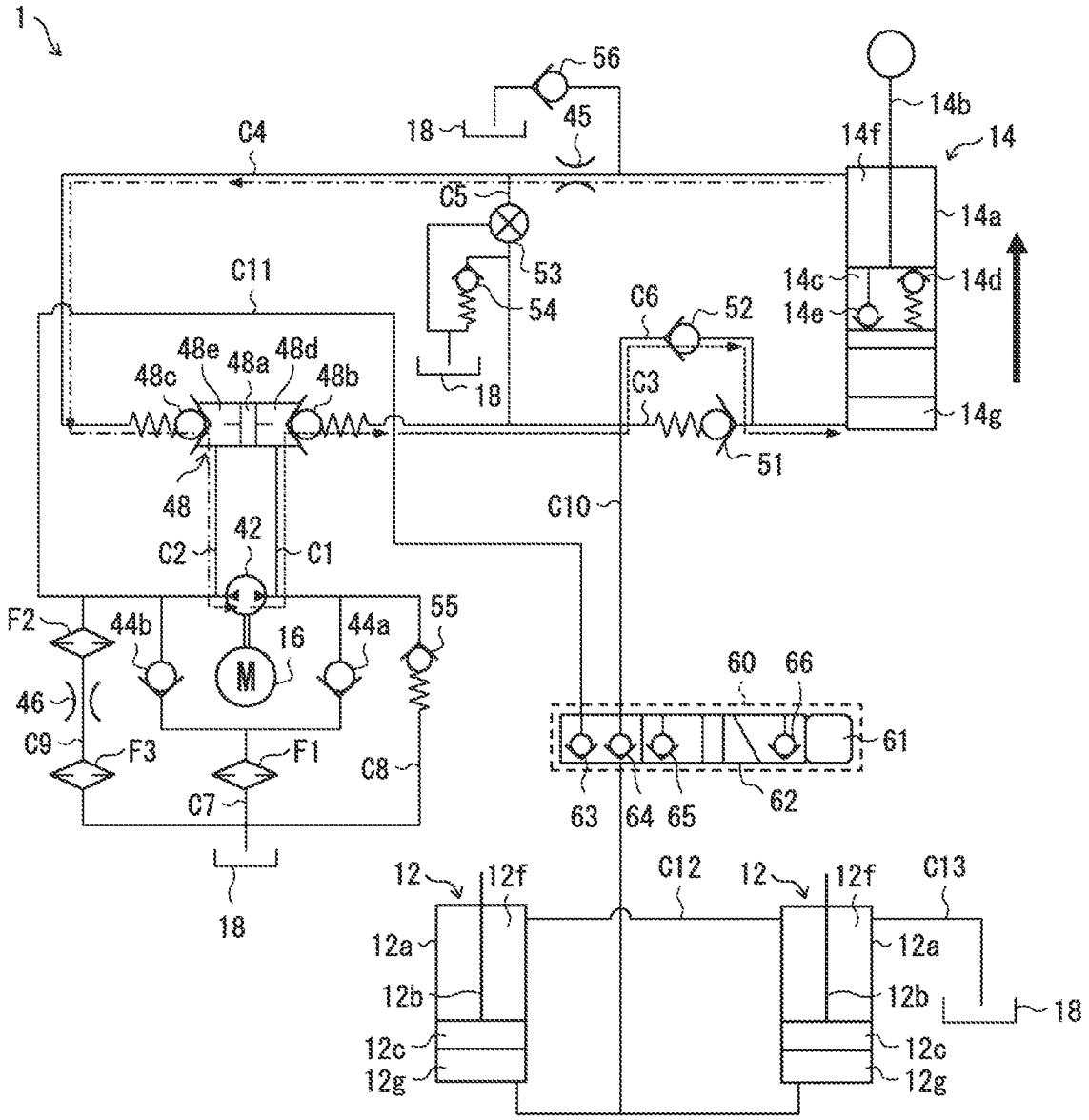
FIG. 6 is a diagram showing a flow of hydraulic oil of the oil-hydraulic circuit of the outboard motor lifting device according to Embodiment 1.

As shown in FIG. 6, the lifting up operation of the outboard motor 300 is performed by means of only the tilt cylinder 14 as follows. First, the switch valve 60 is switched to the second connection state. That is, the switch valve 60 closes communication between the third flow channel C3 and the lower chambers 12*g* of the trim cylinders 12, and closes communication between the eleventh flow channel C11 and the lower chambers 12*g* of the trim cylinders 12.

Next, when the pump 42 rotates in a normal direction, hydraulic oil is pumped from the first discharge port of the pump 42 into the first shuttle chamber 48*d* of the main valve 48 through the first flow channel C1. Thus, the first check valve 48*b* is opened, and the spool 48*a* moves toward the second check valve 48*c* to open the second check valve 48*c*.

Here, when the hydraulic oil is pumped from the first discharge port of the pump 42 as described above, the third check valve 51 closes the third flow channel C3, and the fourth check valve 52 opens the sixth flow channel C6. Therefore, when the first check valve 48*b* is open, the hydraulic oil pumped into the first shuttle chamber 48*d* of the main valve 48 is supplied to the lower chamber 14*g* of the tilt cylinder 14 via the third flow channel C3 and the sixth flow channel C6. As the hydraulic oil is supplied to the lower chamber 14*g* of the tilt cylinder 14, the piston 14*c* of the tilt cylinder 14 slides toward the upper chamber 14*f* of the tilt cylinder 14, and the piston rod 14*b* of the tilt cylinder 14 goes up.

The hydraulic oil pumped by the sliding of the piston 14*c* of the tilt cylinder 14 is supplied from the upper chamber 14*f* of the tilt cylinder 14 to the second shuttle chamber 48*e* of the main valve 48 via the fourth flow channel C4. The hydraulic oil supplied to the second shuttle chamber 48*e* of the main valve 48 is supplied to the pump 42 via the second flow channel C2.

Thus, while the switch valve 60 is in the second connection state, as the pump 42 is rotated in the normal direction, the tilt cylinder 14 can extend suitably.

(First Lifting Down Operation)

A flow of hydraulic oil of the oil-hydraulic circuit for performing a lifting down operation of the outboard motor 300 by means of only the tilt cylinder 14 (which will be referred to as first lifting down operation) will be described below with reference to FIG. 7.

Figure 7:
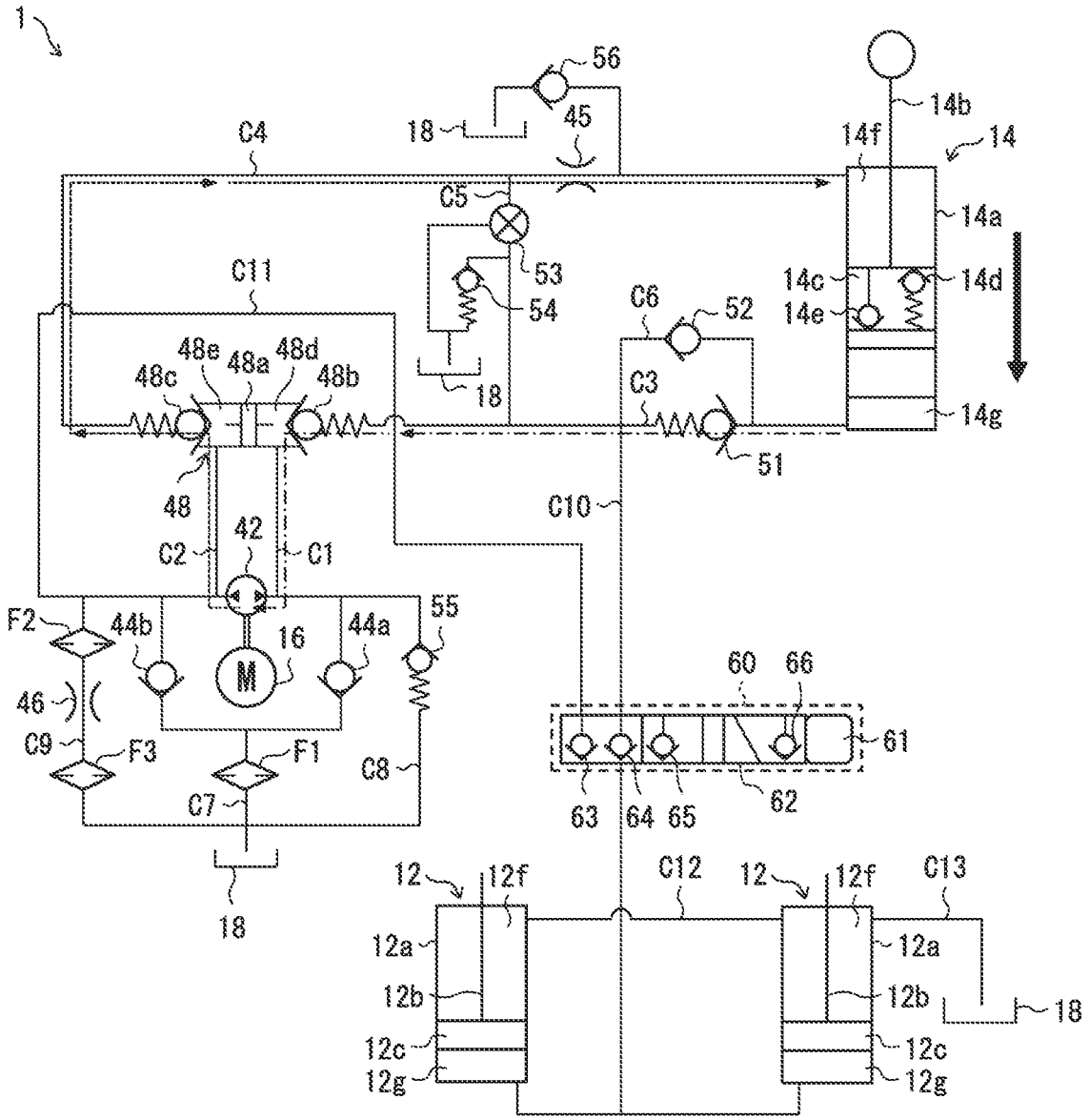
FIG. 7 is a diagram showing a flow of hydraulic oil of the oil-hydraulic circuit of the outboard motor lifting device according to Embodiment 1.

As shown in FIG. 7, the lifting down operation of the outboard motor 300 is performed by means of only the tilt cylinder 14 as follows. First, the switch valve 60 is switched to the second connection state. That is, the switch valve 60 closes communication between the third flow channel C3 and the lower chambers 12*g* of the trim cylinders 12, and closes communication between the eleventh flow channel C11 and the lower chambers 12*g* of the trim cylinders 12. Incidentally, the trim cylinders 12 are in a retracted state in the first lifting down operation.

Next, when the pump 42 rotates in a reverse direction, hydraulic oil is pumped from the second discharge port of the pump 42 into the second shuttle chamber 48*e* of the main valve 48 via the second flow channel C2. Thus, the second check valve 48*c* is opened, and the spool 48*a* moves toward the first check valve 48*b* to open the first check valve 48*b*.

When the second check valve 48*c* is opened, the hydraulic oil pumped into the second shuttle chamber 48*e* of the main valve 48 is supplied to the upper chamber 14*f* of the tilt cylinder 14 via the fourth flow channel C4. As the hydraulic oil is supplied to the upper chamber 14*f* of the tilt cylinder 14, the piston 14*c* of the tilt cylinder 14 slides toward the lower chamber 14*g* of the tilt cylinder 14, and the piston rod 14*b* of the tilt cylinder 14 goes down.

Here, when the hydraulic oil is pumped from the second discharge port of the pump 42 as described above, the third check valve 51 opens the third flow channel C3, and the fourth check valve 52 closes the sixth flow channel C6. Therefore, the hydraulic oil pumped by the sliding of the piston 14*c* of the tilt cylinder 14 is supplied from the lower chamber 14*g* of the tilt cylinder 14 to the first shuttle chamber 48*d* of the main valve 48 via the third flow channel C3. The hydraulic oil supplied to the first shuttle chamber 48*d* of the main valve 48 is supplied to the pump 42 via the first flow channel C1.

Thus, while the switch valve 60 is in the second connection state, as the pump 42 is rotated in the reverse direction, the tilt cylinder 14 can retract suitably.

(Retention Operation of Tilt Cylinder 14)

A retention operation of the tilt cylinder 14 will be described below with reference to FIG. 5.

When the pump 42 is stopped to retain the tilt cylinder 14, the connection state of the switch valve 60 may be any of the first to third connection states.

When the pump 42 is stopped, the third check valve 51 closes the third flow channel C3, and the fourth check valve 52 closes the sixth flow channel C6, as described above. Thus, the third check valve 51 and the fourth check valve 52 prohibit hydraulic oil from flowing out of the lower chamber 14*g* of the tilt cylinder 14. Thus, as the tilt cylinder 14 is retained, the outboard motor 300 can be prevented from lifting down. Accordingly, the outboard motor 300 can be retained suitably.

(Second Lifting Up Operation)

A flow of hydraulic oil of the oil-hydraulic circuit for performing a lifting up operation of the outboard motor 300 by means of the tilt cylinder 14 and the trim cylinders 12 (which will be referred to as second lifting up operation) will be described below with reference to FIG. 8. Here, a flow of hydraulic oil of the oil-hydraulic circuit for performing a lifting up operation of the tilt cylinder 14 is similar to the first lifting up operation. Therefore, only a flow of hydraulic oil for performing a lifting up operation of the trim cylinders 12 will be described below while description about the flow of the hydraulic oil for performing the lifting up operation of the tilt cylinder 14 will be omitted.

Figure 8:
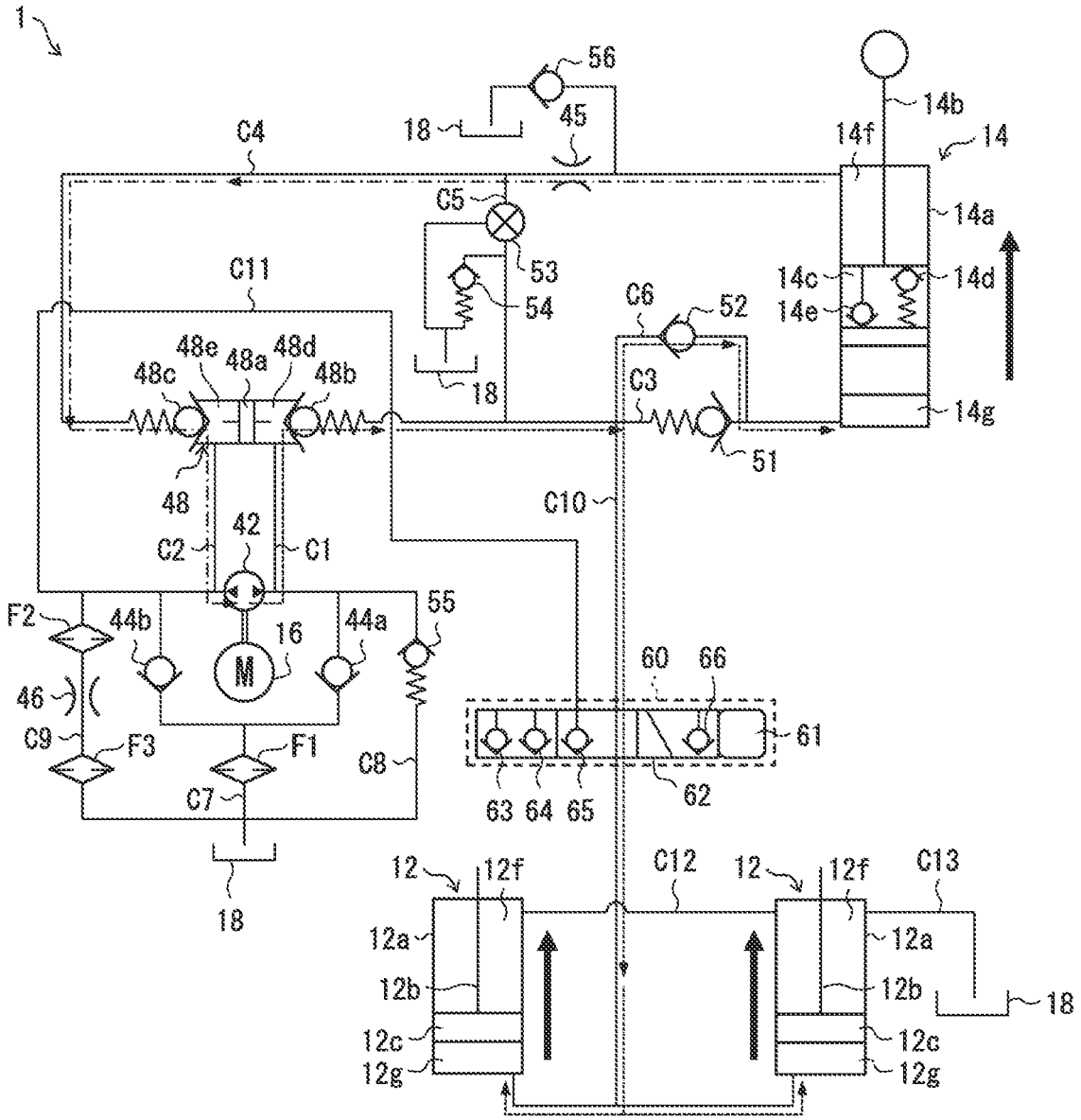
FIG. 8 is a diagram showing a flow of hydraulic oil of the oil-hydraulic circuit of the outboard motor lifting device according to Embodiment 1.

As shown in FIG. 8, the lifting up operation of the outboard motor 300 is performed by means of the tilt cylinder 14 and the trim cylinders 12 as follows. First, the switch valve 60 is switched to the third connection state. That is, the switch valve 60 opens communication between the third flow channel C3 and the lower chambers 12*g* of the trim cylinders 12, but closes communication between the eleventh flow channel C11 and the lower chambers 12*g* of the trim cylinders 12.

Next, when the pump 42 rotates in a normal direction, hydraulic oil is pumped from the first discharge port of the pump 42 into the first shuttle chamber 48*d* of the main valve 48 via the first flow channel C1. Thus, the first check valve 48*b* is opened, and the spool 48*a* moves toward the second check valve 48*c* to open the second check valve 48*c*.

Next, when the first check valve 48*b* is opened, the hydraulic oil pumped into the first shuttle chamber 48*d* of the main valve 48 is supplied to the lower chambers 12*g* of the trim cylinders 12 through the third flow channel C3 and the tenth flow channel C10. As the hydraulic oil is supplied to the lower chambers 12*g* of the trim cylinders 12, the pistons 12*c* of the trim cylinders 12 slide toward the upper chambers 12*f* of the trim cylinders 12, and the piston rods 12*b* of the trim cylinders 12 go up.

Thus, while the switch valve 60 is in the third connection state, as the pump 42 is rotated in the normal direction, the trim cylinders 12 can extend suitably.

(Second Lifting Down Operation)

A flow of hydraulic oil of the oil-hydraulic circuit for performing a lifting down operation of the outboard motor 300 by means of the tilt cylinder 14 and the trim cylinders 12 (which will be referred to as second lifting down operation) will be described below with reference to FIG. 9. Here, a flow of hydraulic oil of the oil-hydraulic circuit for performing a lifting down operation of the tilt cylinder 14 is similar to the first lifting down operation. Therefore, only a flow of hydraulic oil for performing a lifting down operation of the trim cylinders 12 will be described below while description about the flow of the hydraulic oil for performing the lifting down operation of the tilt cylinder 14 will be omitted.

Figure 9:
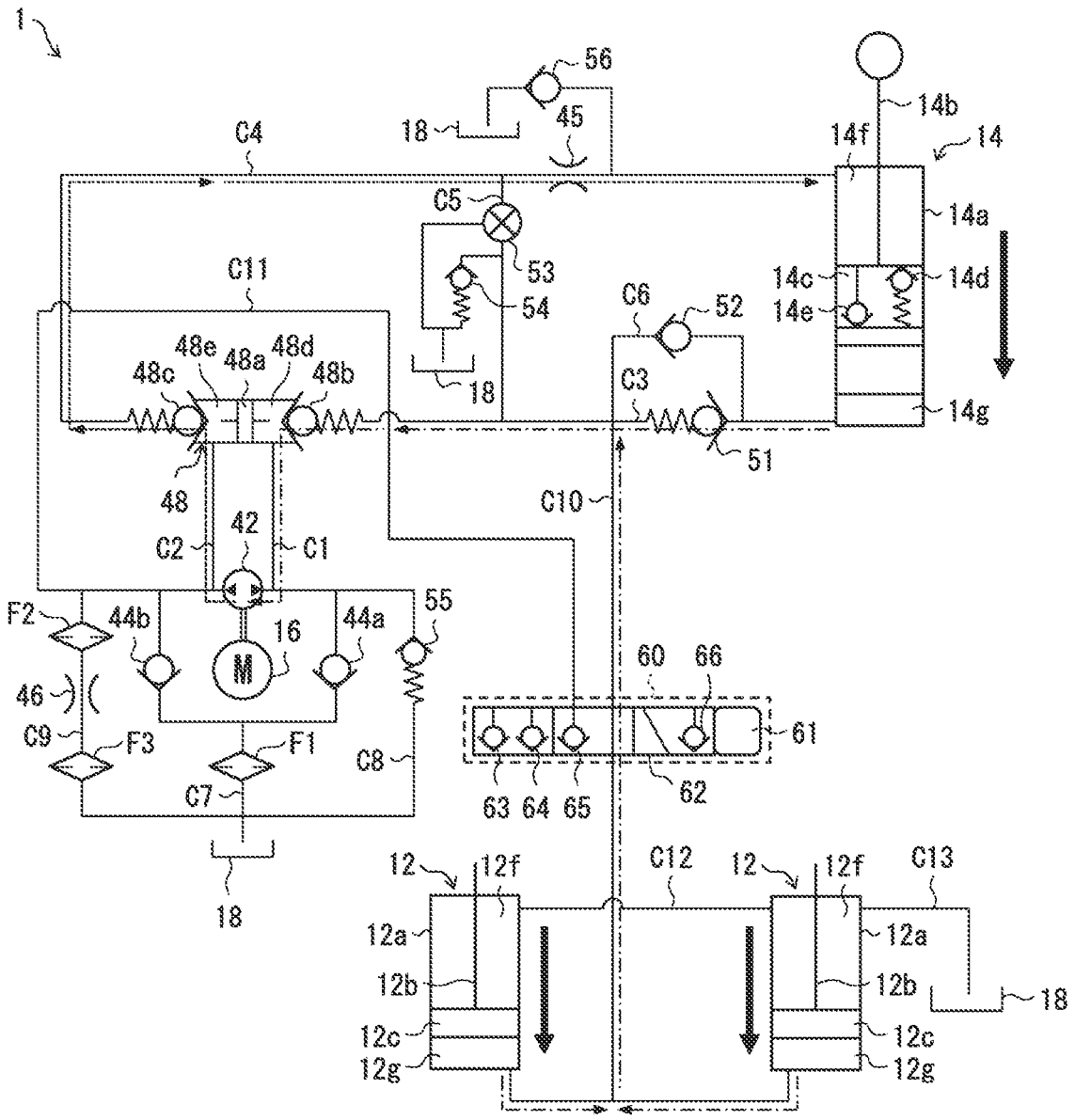
FIG. 9 is a diagram showing a flow of hydraulic oil of the oil-hydraulic circuit of the outboard motor lifting device according to Embodiment 1.

As shown in FIG. 9, the lifting down operation of the outboard motor 300 is performed by means of the tilt cylinder 14 and the trim cylinders 12 as follows. First, the switch valve 60 is switched to the third connection state. That is, the switch valve 60 opens communication between the third flow channel C3 and the lower chambers 12*g* of the trim cylinders 12, but closes communication between the eleventh flow channel C11 and the lower chambers 12*g* of the trim cylinders 12. Incidentally, the trim cylinders 12 are in an extended state in the second lifting down operation.

When the pump 42 rotates in a reverse direction, hydraulic oil in the lower chambers 12*g* of the trim cylinders 12 is supplied to the first shuttle chamber 48*d* of the main valve 48 through the tenth flow channel C10 and the third flow channel C3. The hydraulic oil supplied to the first shuttle chamber 48*d* of the main valve 48 is supplied to the pump 42 through the first flow channel C1. As the hydraulic oil is supplied from the lower chambers 12*g* of the trim cylinders 12, the pistons 12*c* of the trim cylinders 12 slide toward the lower chambers 12*g* of the trim cylinders 12, and the piston rods 12*b* of the trim cylinders 12 goes down.

Thus, while the switch valve 60 is in the third connection state, as the pump 42 is rotated in the reverse direction, the trim cylinders 12 can retract suitably.

(Third Lifting Down Operation)

A flow of hydraulic oil of the oil-hydraulic circuit for performing a lifting down operation of the outboard motor 300 by means of the tilt cylinder 14 and extending the trim cylinders 12 (which will be referred to as third lifting down operation) will be described below with reference to FIG. 10. Here, a flow of hydraulic oil of the oil-hydraulic circuit for performing a lifting down operation of the tilt cylinder 14 is similar to the first lifting down operation. Therefore, only a flow of hydraulic oil for extending the trim cylinders 12 will be described below while description about the flow of the hydraulic oil for performing the lifting down operation of the tilt cylinder 14 will be omitted.

Figure 10:
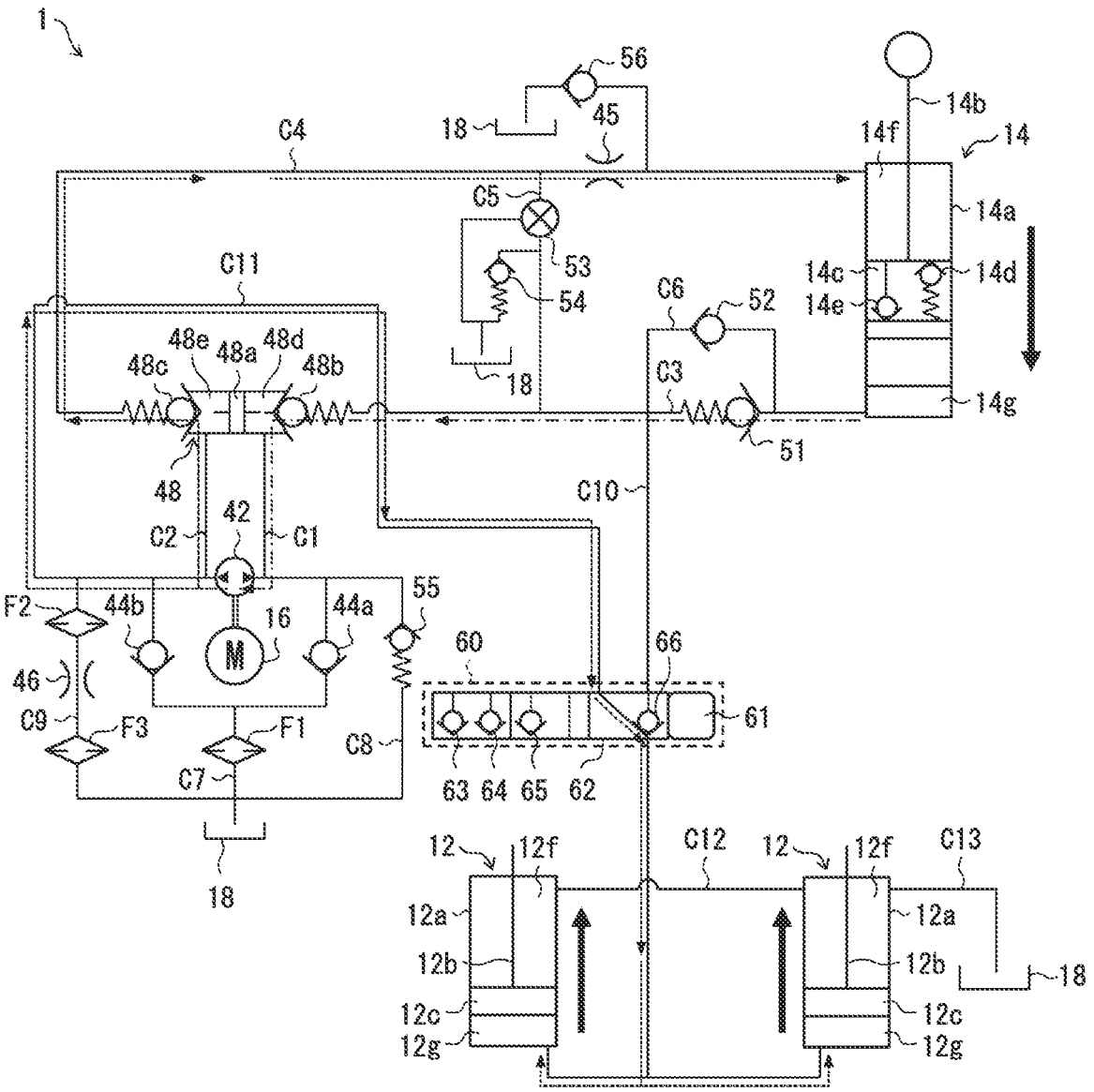
FIG. 10 is a diagram showing a flow of hydraulic oil of the oil-hydraulic circuit of the outboard motor lifting device according to Embodiment 1.

As shown in FIG. 10, the lifting down operation of the outboard motor 300 is performed by means of the tilt cylinder 14 and the trim cylinders 12 are extended as follows. First, the switch valve 60 is switched to the first connection state. That is, the switch valve 60 closes communication between the third flow channel C3 and the lower chambers 12*g* of the trim cylinders 12, but opens communication between the eleventh flow channel C11 and the lower chambers 12*g* of the trim cylinders 12.

When the pump 42 rotates in a reverse direction, hydraulic oil is pumped from the second discharge port of the pump 42 into the lower chambers 12*g* of the trim cylinders 12 through the eleventh flow channel C11 and the tenth flow channel C10. As the hydraulic oil is pumped into the lower chambers 12*g* of the trim cylinders 12, the pistons 12*c* of the trim cylinders 12 slide toward the upper chambers 12*f* of the trim cylinders 12, and the piston rods 12*b* of the trim cylinders 12 goes up.

Thus, while the switch valve 60 is in the first connection state, as the pump 42 is rotated in the reverse direction, the trim cylinders 12 extend. In the oil-hydraulic circuit according to the present embodiment, the hydraulic oil can be pumped from the pump 42 into the lower chambers 12*g* of the trim cylinders 12. Therefore, when the outboard motor 300 is lifted down, the trim cylinders 12 can be extended sufficiently in order to support the lifting down of the outboard motor 300. Accordingly, lifting up and down of the outboard motor 300 can be performed suitably.

Incidentally, the outboard motor lifting device 1 according to the present embodiment may include a control section (not shown) such that the switch valve 60 can be switched based on control of the control section.

Embodiment 2

An outboard motor lifting device 2 according to Embodiment 2 will be described below with reference to FIGS. 11 to 16.

(Oil-Hydraulic Circuit)

Figure 11:
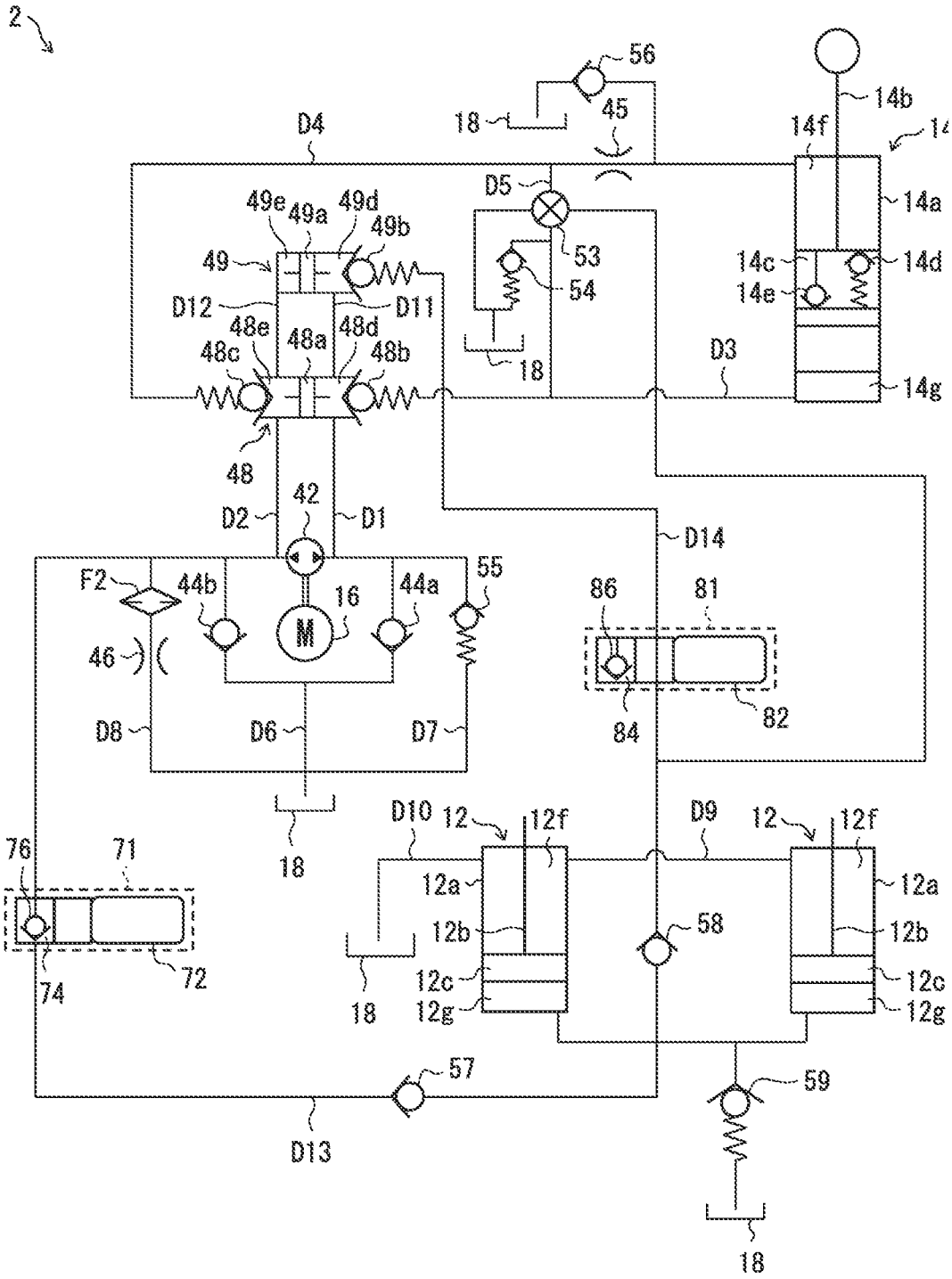
FIG. 11 is a diagram showing the configuration of an oil-hydraulic circuit of an outboard motor lifting device according to Embodiment 2.

An oil-hydraulic circuit of the outboard motor lifting device 2 will be described with reference to FIG. 11. FIG. 11 is a diagram showing the oil-hydraulic circuit of the outboard motor lifting device 2. In the following description, members similar to or the same as the above-described members will be referred to by the same signs correspondingly and respectively, and description thereof will be omitted.

As shown in FIG. 11, the outboard motor lifting device 2 includes a motor 16, a pump 42, a tilt cylinder 14, trim cylinders 12, a first switch valve 71, a second switch valve 81, a first check valve 44*a*, a second check valve 44*b*, a main valve 48 (which will be also referred to as first pump port), a second main valve 49 (which will be also referred to as second pump port), a manual valve 53, a thermal valve 54, an upblow valve 55, an upper chamber oil supply valve 56, a fifth check valve 57, a sixth check valve 58, a seventh check valve 59 (which will be also referred to as check valve), a first orifice 45, a second orifice 46, a tank 18, a filter F2, and a first flow channel D1 to a fourteenth flow channel D14.

The first flow channel D1 connects a first discharge port of the pump 42 with a first shuttle chamber 48*d*, and connects the first discharge port of the pump 42 with the first check valve 44*a*. The second flow channel D2 connects a second discharge port of the pump 42 with a second shuttle chamber 48*e*, and connects the second discharge port of the pump 42 with the second check valve 44*b*.

The third flow channel D3 connects a first check valve 48*b* with a lower chamber 14*g* of the tilt cylinder 14. The fourth flow channel D4 connects a second check valve 48*c* with an upper chamber 14*f* of the tilt cylinder 14. As shown in FIG. 11, the upper chamber oil supply valve 56 is connected to the fourth flow channel D4.

The manual valve 53 and the thermal valve 54 are connected to the fifth flow channel D5 connecting the third flow channel D3 with the fourth flow channel D4. As shown in FIG. 11, the first orifice 45 is disposed on the fourth flow channel D4 between a connection position with the upper chamber oil supply valve 56 and a connection position with the fifth flow channel D5.

Incidentally, the first flow channel D1 and the third flow channel D3 which connect the first discharge port of the pump 42 with the lower chamber 14*g* of the tilt cylinder 14 through the main valve 48 will be also collectively referred to as a second oil channel. The second flow channel D2 and the fourth flow channel D4 which connect the second discharge port of the pump 42 with the upper chamber 14*f* of the tilt cylinder 14 through the main valve 48 will be also collectively referred to as first oil channel.

The sixth flow channel D6 connects the first check valve 44*a* and the second check valve 44*b* with the tank 18.

The seventh flow channel D7 connects the first flow channel D1 with the tank 18 through the upblow valve 55.

The eighth flow channel D8 connects the second flow channel D2 with the tank 18 through the filter F2. As shown in FIG. 11, the second orifice 46 is disposed on the eighth flow channel D8 between the filter F2 and the tank 18.

The ninth flow channel D9 connects upper chambers 12*f* of the trim cylinders 12 to each other. Due to the presence of the ninth flow channel D9, pressures in the upper chambers 12*f* of the trim cylinders 12 are equalized to each other.

The tenth flow channel D10 connects one of the upper chambers 12*f* of the trim cylinders 12 with the tank 18.

As shown in FIG. 11, the second main valve 49 includes a spool 49*a* and a check valve 49*b*. The second main valve 49 is partitioned by the spool 49*a* into a first shuttle chamber 49*d* (which will be also referred to as third shuttle chamber) on the check valve 49*b* side, and a second shuttle chamber 49*e* (which will be also referred to as fourth shuttle chamber) on an opposite side to the check valve 49*b* with respect to the spool 49*a*.

The first shuttle chamber 49*d* in the second main valve 49 is also connected to the first shuttle chamber 48*d* in the main valve 48 through the eleventh flow channel D11. The second shuttle chamber 49*e* in the second main valve 49 is also connected to the second shuttle chamber 48*e* in the main valve 48 through the twelfth flow channel D12.

The thirteenth flow channel D13 (which will be also referred to as third oil channel) connects the second flow channel D2 with lower chambers 12*g* of the trim cylinders 12. As shown in FIG. 11, the first switch valve 71 and the fifth check valve 57 are disposed on the thirteenth flow channel D13.

The fourteenth flow channel D14 (which may be also referred to as fourth oil channel) connects the check valve 49*b* in the second main valve 49 with the lower chambers 12*g* of the trim cylinders 12. In other words, the fourteenth flow channel 14 is connected to the first shuttle chamber 49*d* in the second main valve 49 through the check valve 49*b*. As shown in FIG. 11, the second switch valve 81 and the sixth check valve 58 are disposed on the fourteenth flow channel D14.

As shown in FIG. 11, the fourteenth flow channel D14 is also connected to the manual valve 53. As shown in FIG. 11, the seventh check valve 59 is disposed on the fourteenth flow channel D14 between the sixth check valve 58 and the lower chambers 12*g* of the trim cylinders 12. The fourteenth flow channel D14 is connected to the tank 18 through the seventh check valve 59.

The fifth check valve 57 opens the thirteenth flow channel D13 when hydraulic oil is supplied from the side of the second flow channel D2. The fifth check valve 57 closes the thirteenth flow channel D13 when hydraulic oil is supplied from the sides of the lower chambers 12*g* of the trim cylinders 12.

The sixth check valve 58 opens the fourteenth flow channel D14 when hydraulic oil is supplied from the side of the second main valve 49. The sixth check valve 58 closes the fourteenth flow channel D14 when hydraulic oil is supplied from the sides of the lower chambers 12*g* of the trim cylinders 12.

When oil pressure in each of the lower chambers 12*g* of the trim cylinders 12 increases excessively, the seventh check valve 59 opens itself to supply hydraulic oil to the tank 18. As a result, the seventh check valve 59 releases the excessive oil pressure in the lower chamber 12*g* of the trim cylinder 12. When, for example, piston rods 12*b* of the trim cylinders 12 are pushed inward by an outboard motor 300 which is lifted down, so that the oil pressure in each of the lower chambers 12*g* of the trim cylinders 12 increases excessively, the seventh check valve 59 opens itself to thereby release the excessive oil pressure in the lower chamber 12*g* of the trim cylinder 12.

(First Switch Valve 71)

As shown in FIG. 11, the first switch valve 71 provided on the thirteenth flow channel D13 includes a solenoid 72 and a plunger 74. The plunger 74 is driven by the solenoid 72 to switch the thirteenth flow channel D13 to a closed state or an open state.

The first switch valve 71 may be configured as a normally closed valve which turns to a closed state to thereby close the thirteenth flow channel D13 when the solenoid 72 is OFF, and which turns to an open state to thereby open the thirteenth flow channel D13 when the solenoid 72 is ON, or may be configured as a normally open valve which turns to an open state to thereby open the thirteenth flow channel D13 when the solenoid 72 is OFF, and which turns to a closed state to thereby close the thirteenth flow channel D13 when the solenoid 72 is ON.

Incidentally, in the present embodiment, the plunger 74 includes a protective valve 76 for preventing an excessive increase of oil pressure in each of the lower chambers 12*g* of the trim cylinders 12 in the closed state of the thirteenth flow channel D13.

(Second Switch Valve 81)

As shown in FIG. 11, the second switch valve 81 provided on the fourteenth flow channel D14 includes a solenoid 82 and a plunger 84. The plunger 84 is driven by the solenoid 82 to switch the fourteenth flow channel D14 to a closed state or an open state.

The second switch valve 81 may be configured as a normally closed valve which turns to a closed state to thereby close the fourteenth flow channel D14 when the solenoid 82 is OFF, and which turns to an open state to thereby open the fourteenth flow channel D14 when the solenoid 82 is ON, or may be configured as a normally open valve which turns to an open state to thereby open the fourteenth flow channel D14 when the solenoid 82 is OFF, and which turns to a closed state to thereby close the fourteenth flow channel D14 when the solenoid 82 is ON.

Incidentally, in the present embodiment, the plunger 84 includes a protective valve 86 for preventing an excessive increase of oil pressure in each of the lower chambers 12*g* of the trim cylinders 12 in the closed state of the fourteenth flow channel D14.

(Connection State of Switch Valve)

A connection state of the first switch valve 71 and the second switch valve 81 includes a first connection state, a second connection state and a third connection state. In the first connection state, the first switch valve 71 switches the thirteenth flow channel D13 to a closed state, and the second switch valve 81 switches the fourteenth flow channel D14 to a closed state. In the second connection state, the first switch valve 71 switches the thirteenth flow channel D13 to a closed state, and the second switch valve 81 switches the fourteenth flow channel D14 to an open (communicable) state. In the third connection state, the first switch valve 71 switches the thirteenth flow channel D13 to an open (communicable) state, and the second switch valve 81 switches the fourteenth flow channel D14 to a closed state.

(Operation Example of Outboard Motor Lifting Device 2)

Next, an operation example of the outboard motor lifting device 2 will be described with reference to FIGS. 11 to 16.

(First Lifting Up Operation)

A flow of hydraulic oil of an oil-hydraulic circuit for performing a lifting up operation of the outboard motor 300 by means of only the tilt cylinder 14 (which will be referred to as first lifting up operation) will be described below with reference to FIG. 12.

Figure 12:
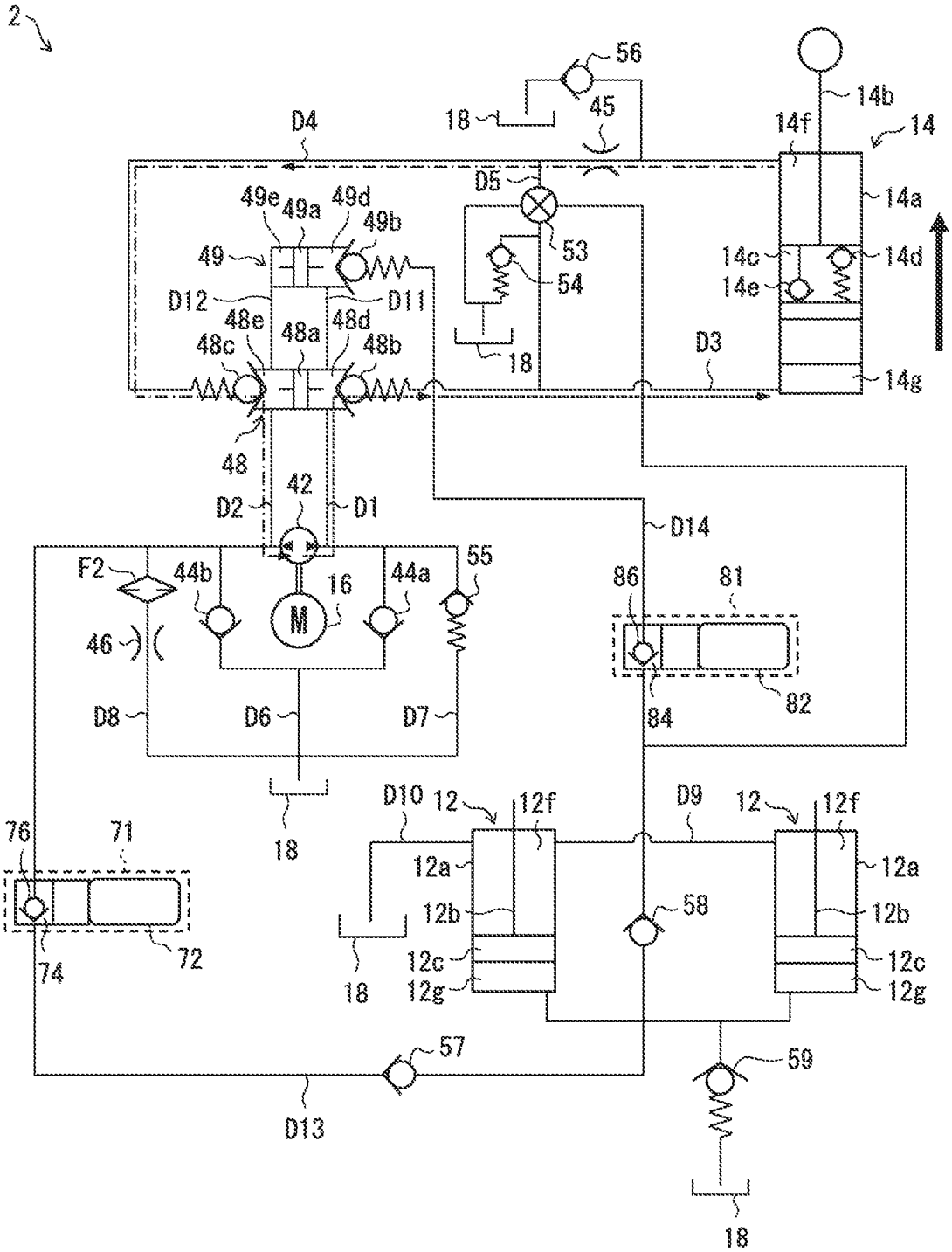
FIG. 12 is a diagram showing a flow of hydraulic oil of the oil-hydraulic circuit of the outboard motor lifting device according to Embodiment 2.

As shown in FIG. 12, the lifting up operation of the outboard motor 300 is performed by means of only the tilt cylinder 14 as follows. First, the first switch valve 71 and the second switch valve 81 are switched to the first connection state. That is, the first switch valve 71 switches the thirteenth flow channel D13 to the closed state, and the second switch valve 81 switches the fourteenth flow channel D14 to the closed state.

Next, when the pump 42 rotates in a normal direction, hydraulic oil is pumped from the first discharge port of the pump 42 into the first shuttle chamber 48*d* of the main valve 48 through the first flow channel D1. Thus, the first check valve 48*b* is opened, and a spool 48*a* moves toward the second check valve 48*c* to open the second check valve 48*c*.

When the first check valve 48*b* is opened, the hydraulic oil pumped into the first shuttle chamber 48*d* of the main valve 48 is supplied to the lower chamber 14*g* of the tilt cylinder 14 through the third flow channel D3. As the hydraulic oil is supplied to the lower chamber 14*g* of the tilt cylinder 14, a piston 14*c* of the tilt cylinder 14 slides toward the upper chamber 14*f* of the tilt cylinder 14, and a piston rod 14*b* of the tilt cylinder 14 goes up.

The hydraulic oil pumped by the sliding of the piston 14*c* of the tilt cylinder 14 is supplied from the upper chamber 14*f* of the tilt cylinder 14 to the second shuttle chamber 48*e* of the main valve 48 through the fourth flow channel D4. The hydraulic oil supplied to the second shuttle chamber 48*e* of the main valve 48 is supplied to the pump 42 through the second flow channel D2.

Thus, while the first switch valve 71 and the second switch valve 81 are in the first connection state, as the pump 42 is rotated in the normal direction, the tilt cylinder 14 can extend suitably.

(First Lifting Down Operation)

A flow of hydraulic oil of the oil-hydraulic circuit for performing a lifting down operation of the outboard motor 300 by means of only the tilt cylinder 14 (which will be referred to as first lifting down operation) will be described below with reference to FIG. 13.

Figure 13:
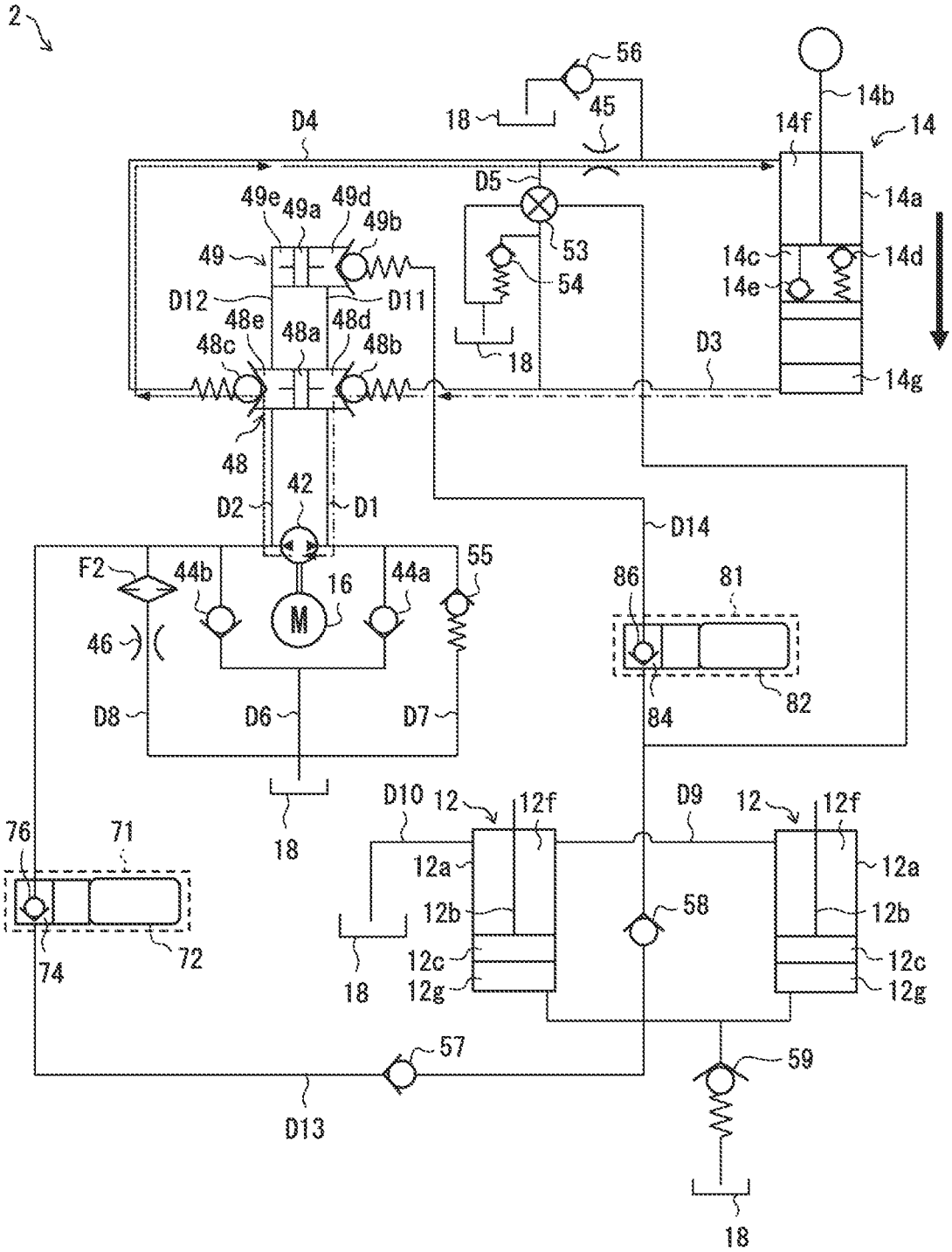
FIG. 13 is a diagram showing a flow of hydraulic oil of the oil-hydraulic circuit of the outboard motor lifting device according to Embodiment 2.

As shown in FIG. 13, the lifting down operation of the outboard motor 300 is performed by means of only the tilt cylinder 14 as follows. First, the first switch valve 71 and the second switch valve 81 are switched to the first connection state. That is, the first switch valve 71 switches the thirteenth flow channel D13 to the closed state, and the second switch valve 81 switches the fourteenth flow channel D14 to the closed state. Incidentally, the trim cylinders 12 are in a retracted state in the first lifting down operation.

Next, when the pump 42 rotates in a reverse direction, hydraulic oil is pumped from the second discharge port of the pump 42 into the second shuttle chamber 48*e* of the main valve 48 through the second flow channel D2. Thus, the second check valve 48*c* is opened, and the spool 48*a* moves toward the first check valve 48*b* to open the first check valve 48*b*.

When the second check valve 48*c* is opened, the hydraulic oil pumped into the second shuttle chamber 48*e* of the main valve 48 is supplied to the upper chamber 14*f* of the tilt cylinder 14 through the fourth flow channel D4. As the hydraulic oil supplied to the upper chamber 14*f* of the tilt cylinder 14, the piston 14*c* of the tilt cylinder 14 slides toward the lower chamber 14*g* of the tilt cylinder 14, and the piston rod 14*b* of the tilt cylinder 14 goes down.

The hydraulic oil pumped by the sliding of the piston 14*c* of the tilt cylinder 14 is supplied from the lower chamber 14*g* of the tilt cylinder 14 to the first shuttle chamber 48*d* of the main valve 48 through the third flow channel D3. The hydraulic oil supplied to the first shuttle chamber 48*d* of the main valve 48 is supplied to the pump 42 through the first flow channel D1.

Thus, while the first switch valve 71 and the second switch valve 81 are in the first connection state, as the pump 42 is rotated in the reverse direction, the tilt cylinder 14 can retract suitably.

(Retention Operation of Tilt Cylinder 14)

A retention operation of the tilt cylinder 14 will be described below with reference to FIG. 11.

When the pump 42 is stopped to retain the tilt cylinder 14, the connection state for the first switch valve 71 and the second switch valve 81 may be any of the first to third connection states.

In the oil-hydraulic circuit according to the present embodiment, the tilt cylinder 14 is connected to the main valve 48 through the third flow channel D3, and the trim cylinders 12 are connected to the second main valve 49 through the fourteenth flow channel D14, as described above. Thus, the oil-hydraulic circuit according to the present embodiment has the tilt cylinder 14 and the trim cylinders 12 connected to the different main valves respectively and correspondingly. With this configuration, the hydraulic oil can be prevented from flowing out of the lower chamber 14*g* of the tilt cylinder 14 when the pump 42 is stopped. Thus, when the tilt cylinder 14 is retained, the outboard motor 300 can be prevented from lifted down. Accordingly, the outboard motor 300 can be retained suitably.

(Second Lifting Up Operation)

A flow of hydraulic oil of the oil-hydraulic circuit for performing a lifting up operation of the outboard motor 300 by means of the tilt cylinder 14 and the trim cylinders 12 (which will be referred to as second lifting up operation) will be described below with reference to FIG. 14. Here, a flow of hydraulic oil of the oil-hydraulic circuit for performing a lifting up operation of the tilt cylinder 14 is similar to the first lifting up operation. Therefore, only a flow of hydraulic oil for performing a lifting up operation of the trim cylinders 12 will be described below while description about the flow of the hydraulic oil for performing the lifting up operation of the tilt cylinder 14 will be omitted.

Figure 14:
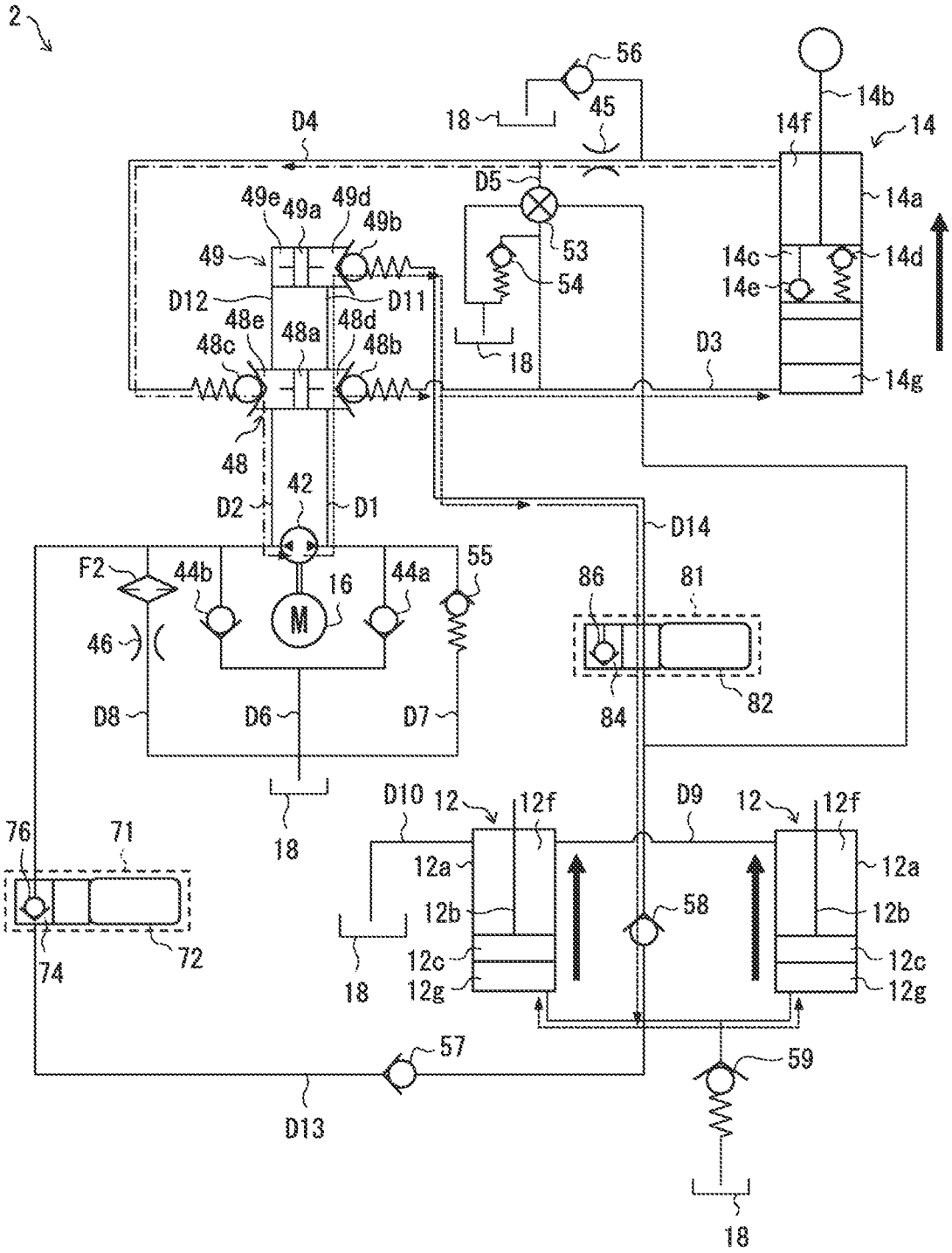
FIG. 14 is a diagram showing a flow of hydraulic oil of the oil-hydraulic circuit of the outboard motor lifting device according to Embodiment 2.

As shown in FIG. 14, the lifting up operation of the outboard motor 300 is performed by means of the tilt cylinder 14 and the trim cylinders 12 as follows. First, the first switch valve 71 and the second switch valve 81 are switched to the second connection state. That is, the first switch valve 71 switches the thirteenth flow channel D13 to the closed state, and the second switch valve 81 switches the fourteenth flow channel D14 to the open (communicable) state.

Next, when the pump 42 rotates in the normal direction, hydraulic oil is pumped from the first discharge port of the pump 42 into the first shuttle chamber 48*d* of the main valve 48 through the first flow channel D1. The hydraulic oil pumped into the first shuttle chamber 48*d* of the main valve 48 is pumped into the first shuttle chamber 49*d* of the second main valve 49 through the eleventh flow channel D11. Thus, the check valve 49*b* of the second main valve 49 is opened.

When the check valve 49*b* is opened, the hydraulic oil pumped into the second main valve 49 is supplied to the lower chambers 12*g* of the trim cylinders 12 through the fourteenth flow channel D14. As the hydraulic oil is supplied to the lower chambers 12*g* of the trim cylinders 12, pistons 12*c* of the trim cylinders 12 slide toward the upper chambers 12*f* of the trim cylinders 12, and the piston rods 12*b* of the trim cylinders 12 goes up.

Thus, while the first switch valve 71 and the second switch valve 81 are in the second connection state, as the pump 42 is rotated in the normal direction, the trim cylinders 12 can extend suitably.

(Second Lifting Down Operation)

A flow of hydraulic oil of the oil-hydraulic circuit for performing a lifting down operation of the outboard motor 300 by means of the tilt cylinder 14 and the trim cylinders 12 (which will be referred to as second lifting down operation) will be described below with reference to FIG. 15. Here, a flow of hydraulic oil of the oil-hydraulic circuit for performing a lifting down operation of the tilt cylinder 14 is similar to the first lifting down operation. Therefore, only a flow of hydraulic oil for performing a lifting down operation of the trim cylinders 12 will be described below while description about the flow of hydraulic oil for performing the lifting down operation of the tilt cylinder 14 will be omitted.

Figure 15:
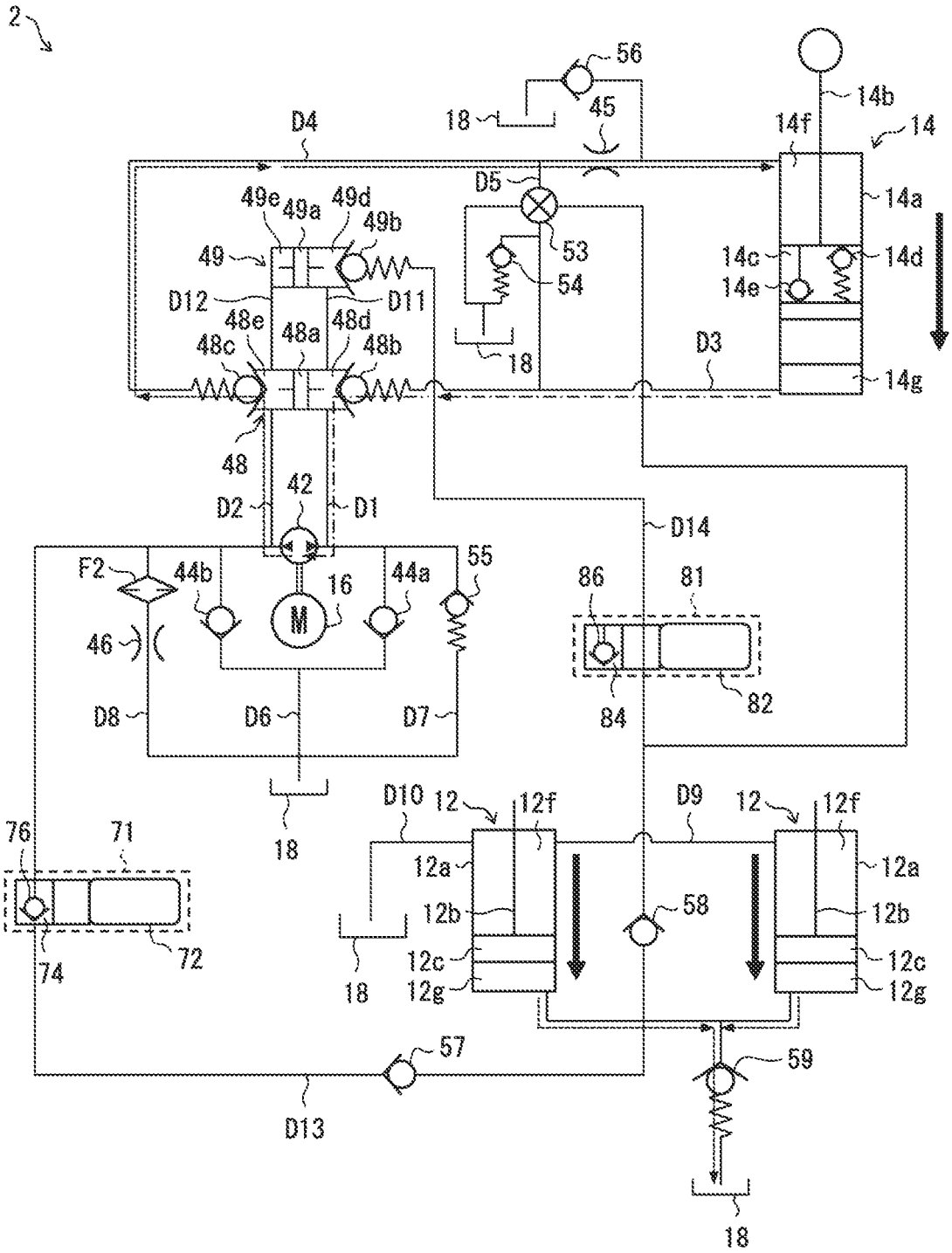
FIG. 15 is a diagram showing a flow of hydraulic oil of the oil-hydraulic circuit of the outboard motor lifting device according to Embodiment 2.

As shown in FIG. 15, the lifting down operation of the outboard motor 300 is performed by means of the tilt cylinder 14 and the trim cylinders 12 as follows. First, the first switch valve 71 and the second switch valve 81 are switched to the second connection state. That is, the first switch valve 71 switches the thirteenth flow channel D13 to the shut state, and the second switch valve 81 switches the fourteenth flow channel D14 to the open (communicable) state. Incidentally, the trim cylinders 12 are in an extended state in the second lifting down operation.

The pump 42 rotates in a reverse direction so that the tilt cylinder 14 retracts. Accordingly, the outboard motor 300 is lifted down. When the outboard motor 300 is lifted down, the piston rods 12*b* of the trim cylinders 12 are pushed inward by the outboard motor 300, so that the pistons 12*c* of the trim cylinders 12 slide toward the lower chambers 12*g* of the trim cylinders 12. Thus, the piston rods 12*b* of the trim cylinders 12 goes down. Hydraulic oil pumped due to the sliding of the piston 12*c* of the trim cylinders 12 is supplied to the tank 18 through the seventh check valve 59.

Thus, while the first switch valve 71 and the second switch valve 81 are in the first connection state and the trim cylinders 12 are in an extended state, as the pump 42 is rotated in the reverse direction, the trim cylinders 12 can retract suitably.

(Third Lifting Down Operation)

A flow of hydraulic oil of the oil-hydraulic circuit for performing a lifting down operation of the outboard motor 300 by means of the tilt cylinder 14 and extending the trim cylinders 12 (which will be referred to as third lifting down operation) will be described below with reference to FIG. 16. Here, a flow of hydraulic oil of the oil-hydraulic circuit for performing a lifting down operation of the tilt cylinder 14 is similar to the first lifting down operation. Therefore, only a flow of hydraulic oil for extending the trim cylinders 12 will be described below while description about the flow of hydraulic oil for performing the lifting down operation of the tilt cylinder 14 will be omitted.

Figure 16:
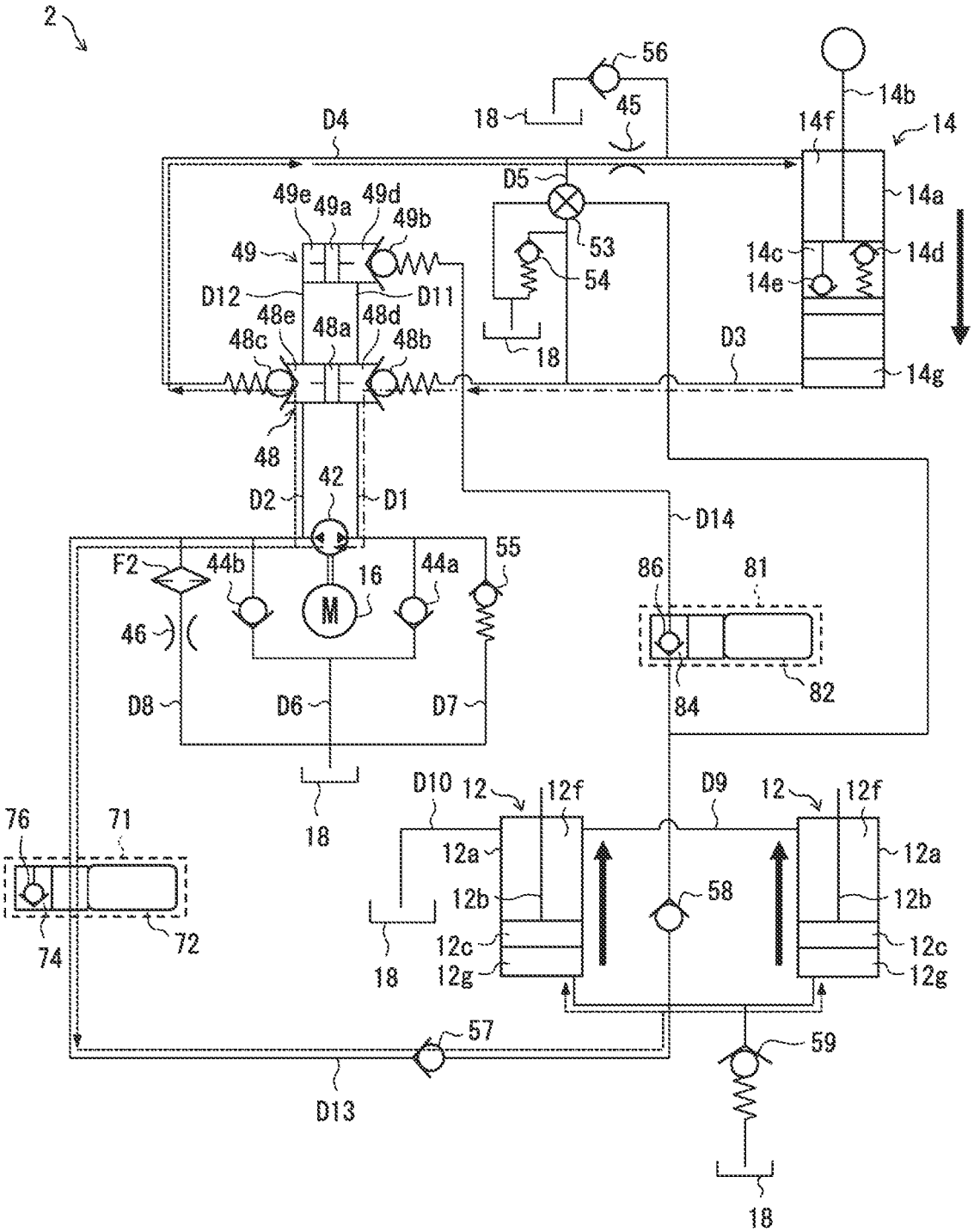
FIG. 16 is a diagram showing a flow of hydraulic oil of the oil-hydraulic circuit of the outboard motor lifting device according to Embodiment 2.

As shown in FIG. 16, the lifting down operation of the outboard motor 300 is performed by means of the tilt cylinder 14 and the trim cylinders 12 are extended as follows. First, the first switch valve 71 and the second switch valve 81 are switched to the third connection state. That is, the first switch valve 71 switches the thirteenth flow channel D13 to the open (communicable) state, and the second switch valve 81 switches the fourteenth flow channel D14 to the closed state.

When the pump 42 rotates in a reverse direction, hydraulic oil is pumped from the second discharge port of the pump 42 into the lower chambers 12*g* of the trim cylinders 12 through the thirteenth flow channel D13. As the hydraulic oil is pumped into the lower chambers 12*g* of the trim cylinders 12, the pistons 12*c* of the trim cylinders 12 slide toward the upper chambers 12*f* of the trim cylinders 12, and the piston rods 12*b* of the trim cylinders 12 goes up.

Thus, while the first switch valve 71 and the second switch valve 81 are in the third connection state, as the pump 42 is rotated in the reverse direction, the trim cylinders 12 extend. In the oil-hydraulic circuit according to the present embodiment, the hydraulic oil can be pumped from the pump 42 into the lower chambers 12*g* of the trim cylinders 12. Therefore, when the outboard motor 300 is lifted down, the trim cylinders 12 can be extended sufficiently in order to support the lifted down of the outboard motor 300. Accordingly, lifting up and down of the outboard motor 300 can be performed suitably.

Embodiment 3

An outboard motor lifting device 3 according to Embodiment 3 will be described below with reference to FIG. 17.

(Oil-Hydraulic Circuit)

An oil-hydraulic circuit of the outboard motor lifting device 3 will be described with reference to FIG. 17. FIG. 17 is a diagram showing the oil-hydraulic circuit of the outboard motor lifting device 3 together with a control section (controller). As shown in FIG. 17, the outboard motor lifting device 3 according to the present embodiment has a configuration in which a first switch valve 711 and a second switch valve 811 are provided in place of the first switch valve 71 and the second switch valve 81 in the outboard motor lifting device 2 according to Embodiment 2. In addition, the outboard motor lifting device 3 according to the present embodiment has a configuration in which a control section (controller) 100 is further provided in the outboard motor lifting device 2 according to Embodiment 2. In the following description, members similar to or the same as the aforementioned members will be referred to by the same signs correspondingly and respectively, and description thereof will be omitted.

(First Switch Valve 711)

The first switch valve 711 is provided on a thirteenth flow channel D13. As shown in FIG. 17, the first switch valve 711 includes a solenoid 712 and a plunger 714. The plunger 714 is driven by the solenoid 712 to switch the thirteenth flow channel D13 to a closed state or an open state. A connection state of the first switch valve 711 is controlled based on control of the control section 100 which will be described later. Specifically, a control signal SIG_CONT is provided from the control section 100 which will be describe later to the first switch valve 711, and the solenoid 712 of the first switch valve 711 is switched between ON and OFF based on the control signal SIG_CONT.

The first switch valve 711 may be configured as a normally closed valve which turns to a closed state to thereby close the thirteenth flow channel D13 when the solenoid 712 is OFF, and which turns to an open state to thereby open the thirteenth flow channel D13 when the solenoid 712 is ON, or may be configured as a normally open valve which turns to an open state to thereby open the thirteenth flow channel D13 when the solenoid 712 is OFF, and which turns to a closed state to thereby close the thirteenth flow channel D13 when the solenoid 712 is ON.

Incidentally, in the present embodiment, the plunger 714 includes a protective valve 716 for preventing an excessive increase of oil pressure in each of lower chambers 12*g* of trim cylinders 12 in the closed state of the thirteenth flow channel D13.

(Second Switch Valve 811)

Figure 17:
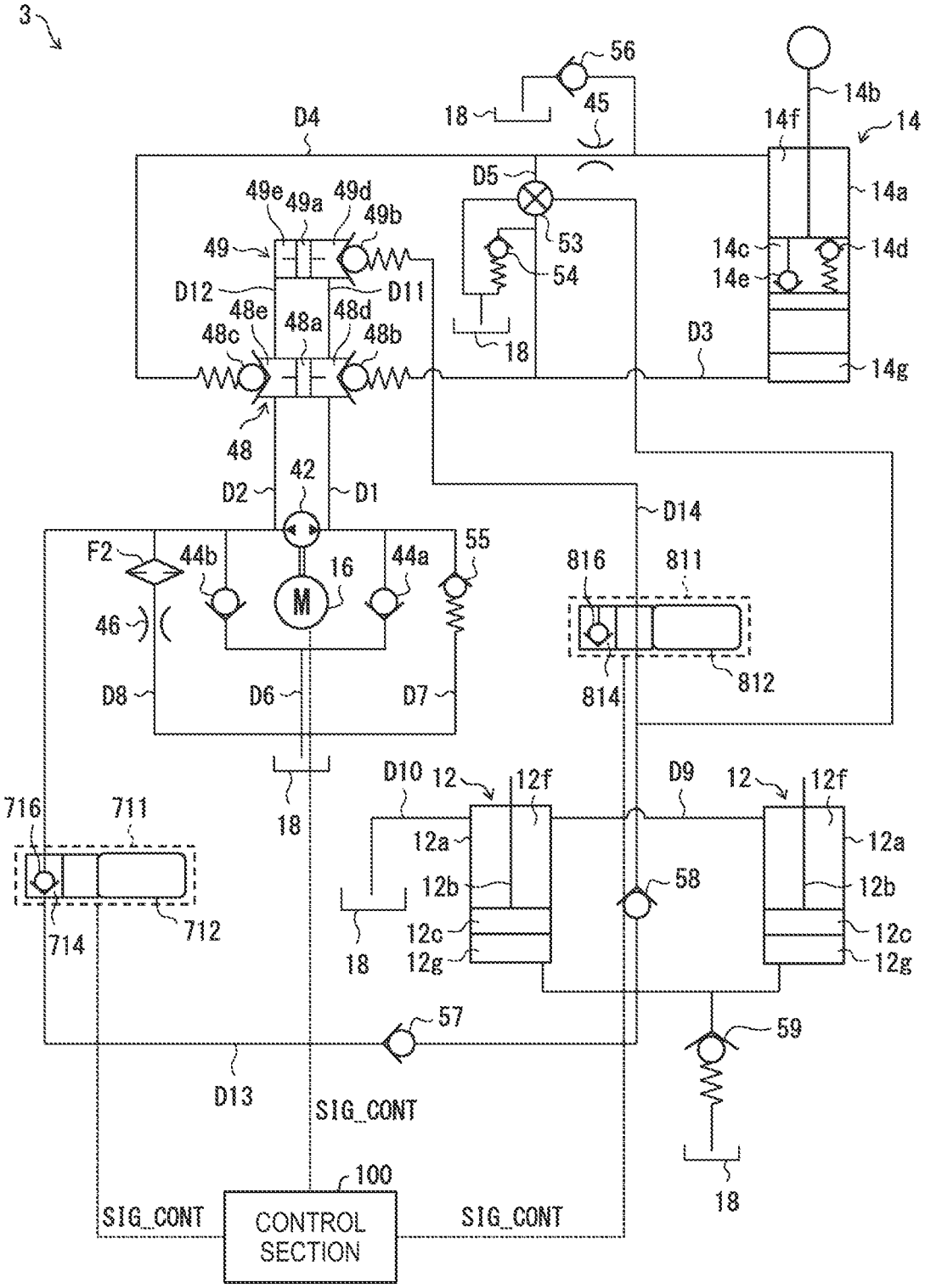
FIG. 17 is a diagram showing an oil-hydraulic circuit of an outboard motor lifting device according to Embodiment 3 together with a control section (controller).

As shown in FIG. 17, the second switch valve 811 provided on a fourteenth flow channel D14 includes a solenoid 812 and a plunger 814. The plunger 814 is driven by the solenoid 812 to switch the fourteenth flow channel D14 to a closed state or an open state. A connection state of the second switch valve 811 is controlled based on control of the control section 100 which will be described later. Specifically, a control signal SIG_CONT is provided from the control section 100 which will be described later to the second switch valve 811, and the solenoid 812 of the second switch valve 811 is switched over between ON and OFF based on the control signal SIG_CONT.

The second switch valve 811 may be configured as a normally closed valve which turns to a closed state to thereby close the fourteenth flow channel D14 when the solenoid 812 is OFF, and which turns to an open state to thereby open the fourteenth flow channel D14 when the solenoid 812 is ON, or may be configured as a normally open valve which turns to an open state to thereby open the fourteenth flow channel D14 when the solenoid 812 is OFF, and which turns to a closed state to thereby close the fourteenth flow channel D14 when the solenoid 812 is ON.

Incidentally, in the present embodiment, the plunger 814 includes a protective valve 816 for preventing an excessive increase of oil pressure in each of the lower chambers 12*g* of the trim cylinders 12 in the closed state of the fourteenth flow channel D14.

(Control Section)

The control section 100 provides the control signal SIG_CONT to each of a motor 16, the first switch valve 711 and the second switch valve 811 in accordance with lifting up and down control of an outboard motor 300 performed by a user. Thus, the control section 100 controls operation of the motor 16 and a connection state of the first switch valve 711 and the second switch valve 811.

(Control Example of Control Section 100)

Next, a control example of the control section 100 for the operation of the outboard motor lifting device 3 will be described.

(First Lifting Up Operation)

To perform control on a first lifting up operation, the control section 100 controls the motor 16 to rotate a pump 42 in a normal direction, and controls the first switch valve 711 and the second switch valve 811 to be a first connection state. That is, the first switch valve 711 switches the thirteenth flow channel D13 to a closed state, and the second switch valve 811 switches the fourteenth flow channel D14 to a closed state. Thus, a tilt cylinder 14 can extend suitably, as described above in Embodiment 2.

(First Lifting Down Operation)

To perform control on a first lifting down operation, the control section 100 controls the motor 16 to rotate the pump 42 in a reverse direction, and controls the first switch valve 711 and the second switch valve 811 to be the first connection state. That is, the first switch valve 711 switches the thirteenth flow channel D13 to the closed state, and the second switch valve 811 switches the fourteenth flow channel D14 to the closed state. Thus, the tilt cylinder 14 can retract suitably, as described above in Embodiment 2.

(Retention Operation of Tilt Cylinder 14)

To perform control on a retention operation of the tilt cylinder 14, the control section 100 controls the motor 16 to stop the pump 42. Incidentally, to perform control on the retention operation of the tilt cylinder 14, the control section 100 may control the connection state of the first switch valve 711 and the second switch valve 811 to any of first to third connection states.

(Second Lifting Up Operation)

To perform control on a second lifting up operation, the control section 100 controls the motor 16 to rotate the pump 42 in a normal direction, and controls the first switch valve 711 and the second switch valve 811 to be the second connection state. That is, the first switch valve 711 switches the thirteenth flow channel D13 to a closed state, and the second switch valve 811 switches the fourteenth flow channel D14 to an open (communicable) state. Thus, trim cylinders 12 can extend suitably, as described above in Embodiment 2.

(Second Lifting Down Operation)

To perform control on a second lifting down operation, the control section 100 controls the motor 16 to rotate the pump 42 in a reverse direction, and controls the first switch valve 711 and the second switch valve 811 to be the second connection state. That is, the first switch valve 711 switches the thirteenth flow channel D13 to the closed state, and the second switch valve 811 switches the fourteenth flow channel D14 to the open (communicable) state. Thus, the trim cylinders 12 can retract suitably, as described above in Embodiment 2.

(Third Lifting Down Operation)

To perform control on a third lifting down operation, the control section 100 controls the motor 16 to rotate the pump 42 in a reverse direction, and controls the first switch valve 711 and the second switch valve 811 to be the third connection state. That is, the first switch valve 711 switches the thirteenth flow channel D13 to an open (communicable) state, and the second switch valve 811 switches the fourteenth flow channel D14 to a closed state. Thus, when the outboard motor 300 is lifted down, the trim cylinders 12 can be extended sufficiently in order to support the lifting down of the outboard motor 300, as described above in Embodiment 2.

The outboard motor lifting device 3 according to the present embodiment includes the control section 100. Accordingly, when malfunction occurs in any of the motor, the switch valves or the like, the control section 100 can detect the malfunction to thereby reduce or prevent abnormal operation in the trim cylinders 12, the tilt cylinder 14, or the like.

The present invention is not limited to the above-described embodiments but may be changed variously within the inventive concept of the present invention. Any embodiment obtained by combining technical aspects disclosed respectively in different embodiments should be also included in the technical scope of the present invention.

The invention claimed is:

1. An outboard motor lifting device configured to lift up and down an outboard motor, the outboard motor lifting device comprising:

one or more tilt cylinders, each including a piston that partitions the tilt cylinder into a first chamber and a second chamber, and a rod that is connected to the piston and penetrates the first chamber of the tilt cylinder;

one or more trim cylinders, each including a piston that partitions the trim cylinder into a first chamber and a second chamber, and a rod that is connected to the piston and penetrates the first chamber of the trim cylinder;

a hydraulic power source;

a first oil channel that connects the hydraulic power source with the second chamber of the one or more tilt cylinders;

a second oil channel that connects the first oil channel with the second chamber of the one or more trim cylinders;

a third oil channel that connects the hydraulic power source with the first chamber of the one or more tilt cylinders;

a check valve that is provided on the first oil channel between the second chamber of the one or more tilt cylinders and a connection position between the first oil channel and the second oil channel, and that is configured to prohibit hydraulic oil from flowing out of the second chamber of the one or more tilt cylinders;

a fourth oil channel that is connected to the third oil channel; and a switch valve that is provided on the second oil channel and to which the fourth oil channel is connected, wherein a connection state of the switch valve includes:

a first connection state in which communication between the first oil channel and the second chamber of the one or more trim cylinders is in a closed state, and communication between the fourth oil channel and the second chamber of the one or more trim cylinders is in an open state.

2. The outboard motor lifting device according to claim 1, wherein:

the connection state of the switch valve further includes:

a second connection state in which the communication between the first oil channel and the second chamber of the one or more trim cylinders is in the closed state, and the communication between the fourth oil channel and the second chamber of the one or more trim cylinders is in a closed state; and a third connection state in which the communication between the first oil channel and the second chamber of the one or more trim cylinders is in an open state, and the communication between the fourth oil channel and the second chamber of the one or more trim cylinders is in the closed state.

3. The outboard motor lifting device according to claim 1, further comprising:

a pump port including a first shuttle chamber connected to the first oil channel, and a second shuttle chamber connected to the second oil channel, wherein the fourth oil channel is connected to the third oil channel between the hydraulic power source and the second shuttle chamber.

4. The outboard motor lifting device according to claim 2, further comprising:

a pump port including a first shuttle chamber connected to the first oil channel, and a second shuttle chamber connected to the second oil channel, wherein the fourth oil channel is connected to the third oil channel between the hydraulic power source and the second shuttle chamber.

5. An outboard motor lifting device configured to lift up and down an outboard motor, the outboard motor lifting device comprising:

one or more tilt cylinders, each including a piston that partitions the tilt cylinder into a first chamber and a second chamber, and a rod that is connected to the piston and penetrates the first chamber of the tilt cylinder;

one or more trim cylinders, each including a piston that partitions the trim cylinder into a first chamber and a second chamber, and a rod that is connected to the piston and penetrates the first chamber of the trim cylinder;

a hydraulic power source;

a first oil channel that connects the hydraulic power source with the first chamber of the one or more tilt cylinders;

a second oil channel that connects the hydraulic power source with the second chamber of the one or more tilt cylinders;

a first pump port that includes a first shuttle chamber connected to the first oil channel, and a second shuttle chamber connected to the second oil channel;

a second pump port that includes a third shuttle chamber connected to the first shuttle chamber, and a fourth shuttle chamber connected to the second shuttle chamber;

a third oil channel that connects the first oil channel with the second chamber of the one or more trim cylinders;

a fourth oil channel that connects the fourth shuttle chamber with the second chamber of the one or more trim cylinders;

a first switch valve that is provided on the third oil channel; and a second switch valve that is provided on the fourth oil channel.

6. The outboard motor lifting device according to claim 5, further comprising:

a check valve that is provided between the first switch valve and the second chamber of the one or more trim cylinders, and between the second switch valve and the second chamber of the one or more trim cylinders.

7. The outboard motor lifting device according to claim 5, wherein:

a connection state of the first switch valve and the second switch valve includes:

a first connection state in which the first switch valve is in a closed state and the second switch valve is in a closed state;

a second connection state in which the first switch valve is in the closed state and the second switch valve is in an open state; and a third connection state in which the first switch valve is in an open state and the second switch valve is in the closed state.

8. The outboard motor lifting device according to claim 6, wherein:

a connection state of the first switch valve and the second switch valve includes:

a first connection state in which the first switch valve is in a closed state and the second switch valve is in a closed state;

a second connection state in which the first switch valve is in the closed state and the second switch valve is in an open state; and a third connection state in which the first switch valve is in an open state and the second switch valve is in the closed state.

9. The outboard motor lifting device according to claim 5, further comprising:

a controller that is configured to control a connection state of the first switch valve and the second switch valve.

10. The outboard motor lifting device according to claim 6, further comprising:

a controller that is configured to control a connection state of the first switch valve and the second switch valve.

11. The outboard motor lifting device according to claim 7, further comprising:

a controller that is configured to control a connection state of the first switch valve and the second switch valve.

12. The outboard motor lifting device according to claim 8, further comprising:

a controller that is configured to control a connection state of the first switch valve and the second switch valve.

* * * * *